US007899376B2

(12) United States Patent
Yamada et al.

(10) Patent No.: US 7,899,376 B2
(45) Date of Patent: Mar. 1, 2011

(54) DEVELOPING DEVICE, IMAGE FORMING APPARATUS, AND IMAGE FORMING SYSTEM

(75) Inventors: Yoichi Yamada, Shiojiri (JP); Takatomo Fukumoto, Shiojiri (JP); Hiroshi Kato, Okuya (JP)

(73) Assignee: Seiko Epson Corporation, Tokyo (JP)

( * ) Notice: Subject to any disclaimer, the term of this patent is extended or adjusted under 35 U.S.C. 154(b) by 497 days.

(21) Appl. No.: 12/124,947

(22) Filed: May 21, 2008

(65) Prior Publication Data

US 2008/0298855 A1 Dec. 4, 2008

(30) Foreign Application Priority Data

May 30, 2007 (JP) ..... 2007-144063

(51) Int. Cl.
*G03G 15/06* (2006.01)
*G03G 15/08* (2006.01)

(52) U.S. Cl. ..... 399/284; 399/264

(58) Field of Classification Search ..... 399/264, 399/265, 279, 284
See application file for complete search history.

(56) References Cited

U.S. PATENT DOCUMENTS 4,780,741 A 10/1988 Wada et al.
4,788,570 A * 11/1988 Ogata et al. ..... 399/283
5,794,109 A 8/1998 Ota et al.
7,155,151 B2 * 12/2006 Okamoto ..... 399/279
7,636,538 B2 * 12/2009 Okamoto et al. ..... 399/284
2005/0185980 A1 * 8/2005 Okamoto ..... 399/103
2007/0110481 A1 * 5/2007 Yamada et al. ..... 399/279
2008/0273901 A1 11/2008 Toyama et al.

FOREIGN PATENT DOCUMENTS

EP 1930787 A1 6/2008
JP 04134375 A 5/1992
JP 08-286496 11/1996

(Continued)

OTHER PUBLICATIONS

European Search Report for corresponding European application 08009804.9-2209 lists the references above.

*Primary Examiner*—David M Gray
*Assistant Examiner*—Fred Braum
(74) *Attorney, Agent, or Firm*—DLA Piper LLP (US)

(57) ABSTRACT

A developing device includes a rotatable toner bearing roller and a regulation blade. The toner bearing roller has regularly-arranged projecting sections and non-projecting sections, bears toner whose volume average particle diameter is smaller than a depth of the non-projecting section relative to the projecting section, and develops a latent image borne on an image bearing member with the toner borne on the toner bearing roller. The regulation blade is for regulating an amount of the toner borne on the toner bearing roller, and abuts, with a predetermined width, against a circumferential surface of the toner bearing roller in a circumferential direction thereof in such a manner that a longitudinal direction of the regulation blade is along a direction of a rotation axis of the toner bearing roller. A tip edge of the regulation blade in a lateral direction and a thickness direction thereof is located within an abutting section having the predetermined width. The predetermined width is larger than a maximum width, in the circumferential direction, of the non-projecting section.

7 Claims, 16 Drawing Sheets

FOREIGN PATENT DOCUMENTS

| | | | |
|---|---|---|---|
| JP | 2003-057940 | | 2/2003 |
| JP | 2003107905 | A | 4/2003 |
| JP | 2006-259384 | | 9/2006 |
| JP | 2007072480 | A * | 3/2007 |
| JP | 2007-086238 | | 4/2007 |

* cited by examiner

DEVELOPING DEVICE, IMAGE FORMING APPARATUS, AND IMAGE FORMING SYSTEM

CROSS-REFERENCE TO RELATED APPLICATIONS

The present application claims priority from Japanese Patent Application No. 2007-144063 filed on May 30, 2007, which is herein incorporated by reference.

BACKGROUND

1. Technical Field

The present invention relates to developing devices, image forming apparatuses, and image forming systems.

2. Related Art

Image forming apparatuses such as laser beam printers are well known. Such image forming apparatuses include, for example, a photoconductor as an example of an image bearing member for bearing a latent image, and a developing device for developing the latent image borne on the photoconductor. In the case where image signals etc. are sent out from an external device such as a host computer, the image forming apparatus positions the developing device at a developing position which is in opposition to the photoconductor. The latent image borne on the photoconductor is then developed with toner contained in the developing device, and a toner image is formed on the photoconductor. The image forming apparatus then transfers the toner image onto a medium, to ultimately form an image on the medium.

In order to achieve the above-mentioned function of developing the latent image borne on the photoconductor and other functions, the developing device has: a rotatable toner bearing roller that bears the toner and develops the latent image with the toner; and a regulation blade that abuts, with a predetermined width, against the circumferential surface of the toner bearing roller in its circumferential direction in such a manner that the longitudinal direction of the blade is along the direction of a rotation axis of the toner bearing roller, and that regulates the amount of toner borne on the toner bearing roller. The toner bearing roller develops the latent image borne on the photoconductor with the toner that is borne on the toner bearing roller and that has been regulated in amount by the regulation blade.

Further, among such toner bearing rollers, there are those that have projections and depressions (projecting sections and non-projecting sections) arranged regularly on its surface. (See, for example, JP-A-2006-259384 and JP-A-2003-57940.)

As regards the style (mode) according to which the above-mentioned regulation blade performs regulation, the so-called non-edge regulation (or flat-region-abutment regulation; a regulation style in which the tip edge, in the lateral direction and the thickness direction, of the regulation blade is not located within an abutting section having the above-mentioned predetermined width) is well known. There are cases, however, in which it is effective to adopt the so-called edge regulation (a regulation style in which the tip edge, in the lateral direction and the thickness direction, of the regulation blade is located within the abutting section having the above-mentioned predetermined width), from the viewpoint of curbing occurrence of development memory (development hysteresis), for example.

However, in cases where edge regulation is adopted, there is a possibility that, at the time the regulation blade regulates the amount of toner borne on the toner bearing roller, the tip edge of the regulation blade may enter into and collide against the non-projecting section of the toner bearing roller, thereby causing the tip edge to curl up or chip away. Such a problem is a cause of impairing the functionality of the regulation blade.

SUMMARY

An advantage achieved by some aspects of the present invention is that it is possible to curb functionality impairment of the regulation blade.

A primary aspect of the invention is a developing device including: a rotatable toner bearing roller that has regularly-arranged projecting sections and non-projecting sections, that bears toner whose volume average particle diameter is smaller than a depth of the non-projecting section relative to the projecting section, and that develops a latent image borne on an image bearing member with the toner borne on the toner bearing roller; and a regulation blade that is for regulating an amount of the toner borne on the toner bearing roller and that abuts, with a predetermined width, against a circumferential surface of the toner bearing roller in a circumferential direction thereof in such a manner that a longitudinal direction of the regulation blade is along a direction of a rotation axis of the toner bearing roller, a tip edge of the regulation blade in a lateral direction and a thickness direction thereof being located within an abutting section having the predetermined width, the predetermined width being larger than a maximum width, in the circumferential direction, of the non-projecting section.

Other features of this invention will be made clear through the description of the present specification with reference to the accompanying drawings.

DESCRIPTION OF EXEMPLARY EMBODIMENTS

Figure 1:
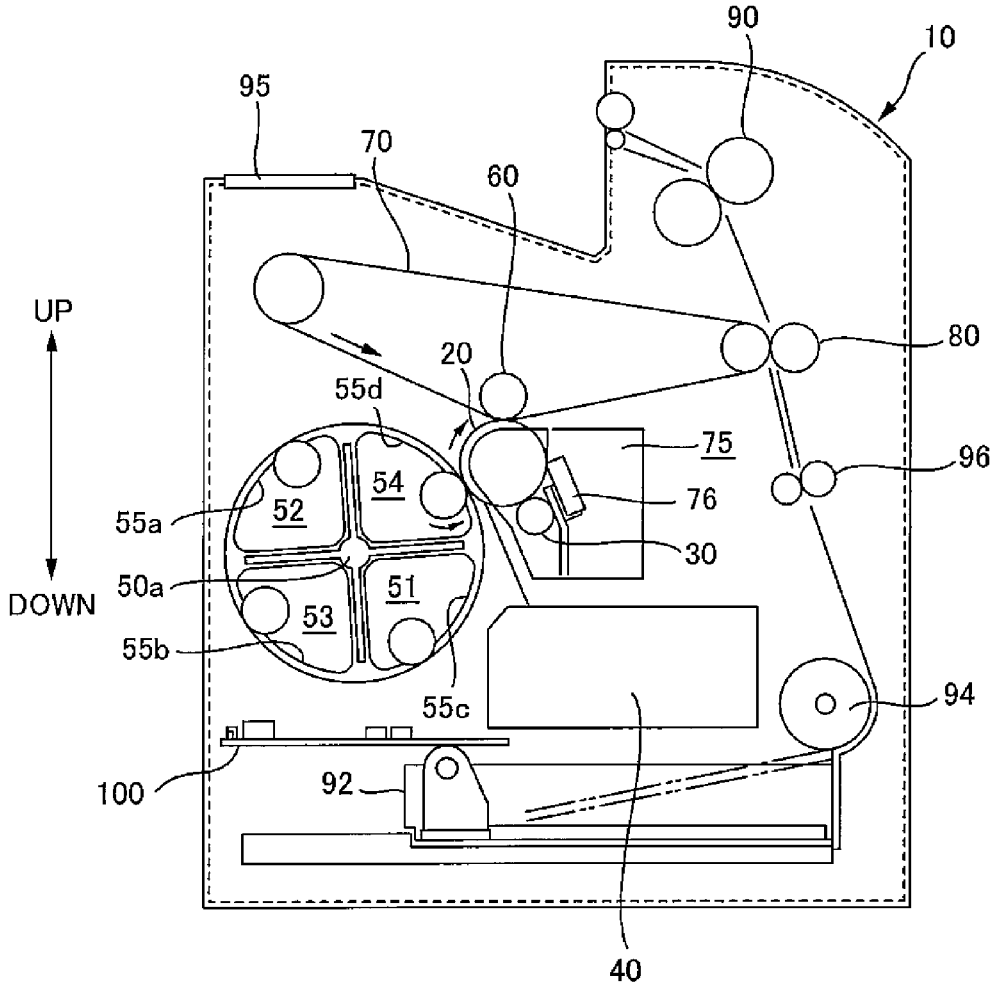
FIG. 1 is a diagram showing main structural components constituting a printer 10.

At least the following matters will be made clear by the present specification and the accompanying drawings.

A developing device includes: a rotatable toner bearing roller that has regularly-arranged projecting sections and non-projecting sections, that bears toner whose volume average particle diameter is smaller than a depth of the non-projecting section relative to the projecting section, and that develops a latent image borne on an image bearing member with the toner borne on the toner bearing roller; and a regulation blade that is for regulating an amount of the toner borne on the toner bearing roller and that abuts, with a predetermined width, against a circumferential surface of the toner bearing roller in a circumferential direction thereof in such a manner that a longitudinal direction of the regulation blade is along a direction of a rotation axis of the toner bearing roller, a tip edge of the regulation blade in a lateral direction and a thickness direction thereof being located within an abutting section having the predetermined width, the predetermined width being larger than a maximum width, in the circumferential direction, of the non-projecting section.

With this developing device, functionality impairment of the regulation blade is appropriately curbed.

Further, the predetermined width may be larger than a sum of a width, in the circumferential direction, of the non-projecting section and a value twice a width, in the circumferential direction, of the projecting section, over a range extending from one end to another end, in the longitudinal direction, of the regulation blade.

In this case, functionality impairment of the regulation blade is curbed even more appropriately.

Further, the predetermined width may be larger than a sum of a value twice a width, in the circumferential direction, of the non-projecting section and a width, in the circumferential direction, of the projecting section, over a range extending from one end to another end, in the longitudinal direction, of the regulation blade.

In this case, functionality impairment of the regulation blade is curbed even more appropriately.

Further, of a first surface of the regulation blade along the lateral direction and a second surface of the regulation blade along the thickness direction, the abutting section having the predetermined width may be provided on the first surface; and the tip edge may be located at one end, in the lateral direction, of the abutting section.

In this case, it is possible to easily achieve a developing device in which the predetermined width is larger than the maximum width, in the circumferential direction, of the non-projecting section.

Further, the non-projecting section may include a depressed section and a side section that connects the projecting section and the depressed section; and a boundary between the side section and a section of the projecting section located downstream in a rotating direction of the toner bearing roller may be rounded off.

In this case, functionality impairment of the regulation blade is appropriately curbed, even if the tip edge enters into the non-projecting section.

It is also possible to achieve an image forming apparatus including: an image bearing member for bearing a latent image; and a developing device having a rotatable toner bearing roller that has regularly-arranged projecting sections and non-projecting sections, that bears toner whose volume average particle diameter is smaller than a depth of the non-projecting section relative to the projecting section, and that develops the latent image borne on the image bearing member with the toner borne on the toner bearing roller, and a regulation blade that is for regulating an amount of the toner borne on the toner bearing roller and that abuts, with a predetermined width, against a circumferential surface of the toner bearing roller in a circumferential direction thereof in such a manner that a longitudinal direction of the regulation blade is along a direction of a rotation axis of the toner bearing roller, a tip edge of the regulation blade in a lateral direction and a thickness direction thereof being located within an abutting section having the predetermined width, the predetermined width being larger than a maximum width, in the circumferential direction, of the non-projecting section.

With this image forming apparatus, functionality impairment of the regulation blade is appropriately curbed.

It is also possible to achieve an image forming system including: a computer; and an image forming apparatus connectable to the computer, the image forming apparatus having: an image bearing member for bearing a latent image; and a developing device having a rotatable toner bearing roller that has regularly-arranged projecting sections and non-projecting sections, that bears toner whose volume average particle diameter is smaller than a depth of the non-projecting section relative to the projecting section, and that develops the latent image borne on the image bearing member with the toner borne on the toner bearing roller, and a regulation blade that is for regulating an amount of the toner borne on the toner bearing roller and that abuts, with a predetermined width, against a circumferential surface of the toner bearing roller in a circumferential direction thereof in such a manner that a longitudinal direction of the regulation blade is along a direction of a rotation axis of the toner bearing roller, a tip edge of the regulation blade in a lateral direction and a thickness direction thereof being located within an abutting section having the predetermined width, the predetermined width being larger than a maximum width, in the circumferential direction, of the non-projecting section.

With this image forming system, functionality impairment of the regulation blade is appropriately curbed.

Overall Configuration Example of Image Forming Apparatus

Next, with reference to FIG. 1, an outline of an image forming apparatus will be described, taking a laser-beam printer 10 (hereinafter referred to also as a printer) as an example. FIG. 1 is a diagram showing main structural components constructing the printer 10. Note that in FIG. 1, the vertical direction is shown by the arrow, and, for example, a paper supply tray 92 is arranged in a lower section of the printer 10, and a fusing unit 90 is arranged in an upper section of the printer 10.

As shown in FIG. 1, the printer 10 according to this embodiment has a charging unit 30, an exposing unit 40, a YMCK developing unit 50, a first transferring unit 60, an intermediate transferring member 70, and a cleaning unit 75. These components are arranged along the direction of rotation of a photoconductor 20 as an example of an image bearing member. The printer 10 is further provided with a second transferring unit 80, a fusing unit 90, a displaying unit 95 constructed of a liquid-crystal panel and serving as means for making notifications to a user, and a control unit 100 for controlling these units etc. and managing the operations as a printer.

The photoconductor 20 has a cylindrical electrically-conductive base and a photoconductive layer formed on the outer circumferential surface of the base, and it is rotatable about its central axis. In this embodiment, the photoconductor 20 rotates clockwise, as shown by the arrow in FIG. 1.

The charging unit 30 is a device for electrically charging the photoconductor 20. The exposing unit 40 is a device for forming a latent image on the charged photoconductor 20 by radiating a laser beam thereon. The exposing unit 40 has, for example, a semiconductor laser, a polygon mirror, and an F-θ lens, and radiates a modulated laser beam onto the charged photoconductor 20 in accordance with image signals having been input from a not-shown host computer such as a personal computer or a word processor.

The YMCK developing unit 50 is a device for developing the latent image formed on the photoconductor 20 using toner contained in each developing device, that is, black (K) toner contained in ablack developing device 51, magenta (M) toner contained in a magenta developing device 52, cyan (C) toner contained in a cyan developing device 53, and yellow (Y) toner contained in a yellow developing device 54.

The YMCK developing unit 50 can move the positions of the four developing devices 51, 52, 53, and 54 by rotating while the four developing devices 51, 52, 53, and 54 are in an attached state. More specifically, the YMCK developing unit 50 holds the four developing devices 51, 52, 53, and 54 respectively with four holding sections 55*a*, 55*b*, 55*c*, and 55*d*. The four developing devices 51, 52, 53, and 54 can be rotated about a central shaft 50*a* while maintaining their relative positions. Every time image formation for one page is finished, each of the developing devices selectively opposes the photoconductor 20, to thereby successively develop the latent image formed on the photoconductor 20 using the toner contained in each of the developing devices 51, 52, 53, and 54. Note that each of the four developing devices 51, 52, 53, and 54 described above is attachable to and detachable from the respective holding sections of the YMCK developing unit 50. Further, details on the developing devices will be described further below.

The first transferring unit 60 is a device for transferring, onto the intermediate transferring member 70, a single-color toner image formed on the photoconductor 20. In the case where the toners of all four colors are successively transferred in a superimposing manner, a full-color toner image will be formed on the intermediate transferring member 70.

The intermediate transferring member 70 is a laminated endless belt that is made by providing a vapor-deposited tin layer on the surface of a PET film, and then further applying semiconducting coating on the outer layer thereof. The intermediate transferring member 70 is driven to rotate at substantially the same circumferential speed as the photoconductor 20.

The second transferring unit 80 is a device for transferring the single-color toner image or the full-color toner image formed on the intermediate transferring member 70 onto a medium such as paper, film, and cloth.

The fusing unit 90 is a device for fusing the single-color toner image or the full-color toner image, which has been transferred onto the medium, to the medium to make it into a permanent image.

The cleaning unit 75 is a device that is provided between the first transferring unit 60 and the charging unit 30, that has a rubber cleaning blade 76 made to abut against the surface of the photoconductor 20, and that is for removing the toner remaining on the photoconductor 20 by scraping it off with the cleaning blade 76 after the toner image has been transferred onto the intermediate transferring member 70 by the first transferring unit 60.

Figure 2:
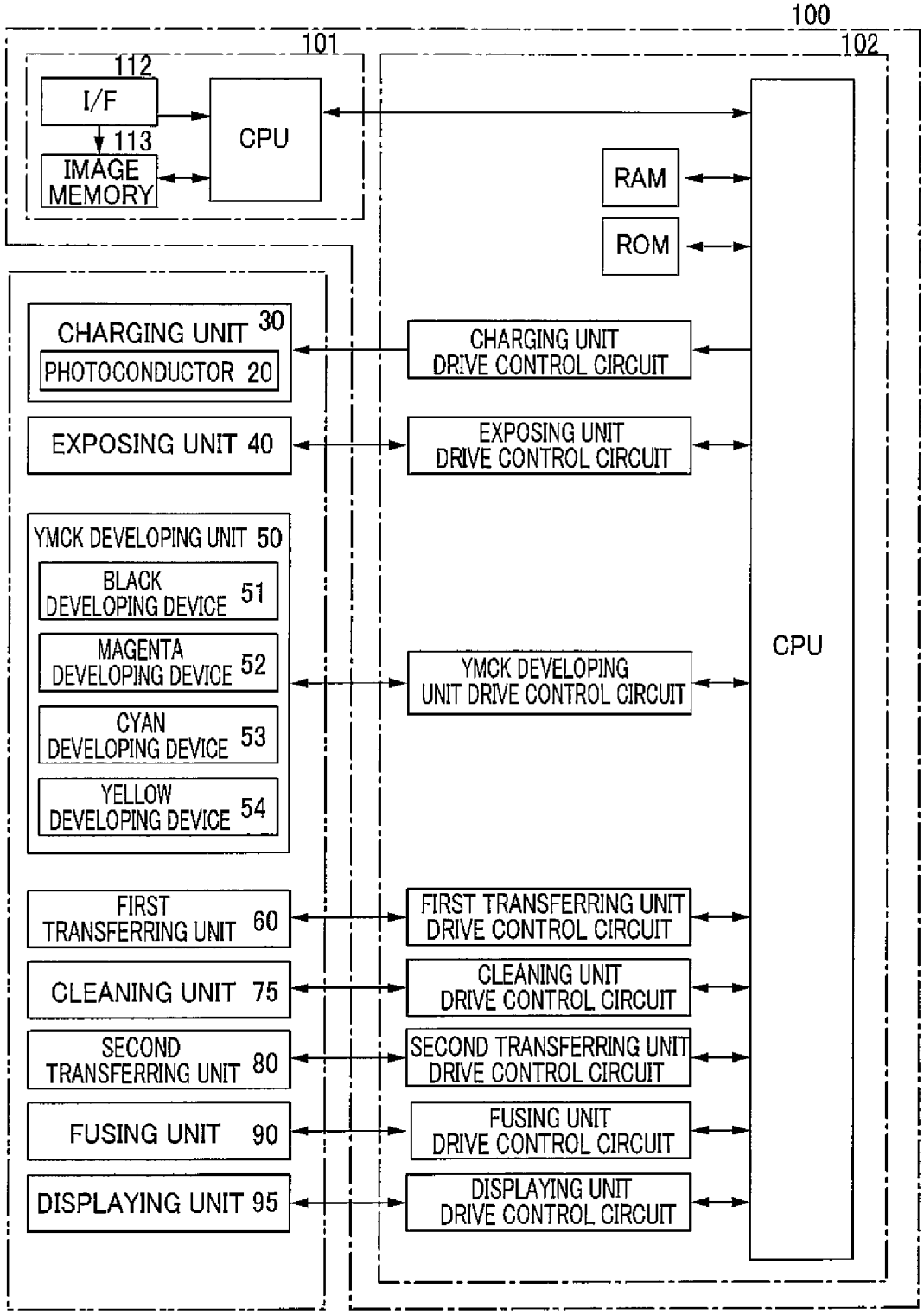
FIG. 2 is a block diagram showing a control unit of the printer 10 of FIG. 1.

The control unit 100 is made up of a main controller 101 and a unit controller 102 as shown in FIG. 2. Image signals and control signals are input to the main controller 101, and according to instructions based on the image signals and control signals, the unit controller 102 controls each of the above-mentioned units etc. to form an image.

Next, operations of the printer 10 structured as above will be described.

First, in cases where image signals and control signals are input from the not-shown host computer to the main controller 101 of the printer 10 through an interface (I/F) 112, the photoconductor 20 and the intermediate transferring member 70 rotate under the control of the unit controller 102 based on the instructions from the main controller 101. While being rotated, the photoconductor 20 is successively charged by the charging unit 30 at a charging position.

With the rotation of the photoconductor 20, the charged area of the photoconductor 20 reaches an exposing position. A latent image according to image information about the first color, for example, yellow Y, is formed in that area by the exposing unit 40. Further, the YMCK developing unit 50 positions the yellow developing device 54, which contains yellow (Y) toner, at the developing position, which is in opposition to the photoconductor 20.

With the rotation of the photoconductor 20, the latent image formed on the photoconductor 20 reaches the developing position, and is developed with the yellow toner by the yellow developing device 54. Thus, a yellow toner image is formed on the photoconductor 20.

With the rotation of the photoconductor 20, the yellow toner image formed on the photoconductor 20 reaches a first transferring position, and is transferred onto the intermediate transferring member 70 by the first transferring unit 60. At this time, a first transferring voltage, which is in an opposite polarity from the polarity to which the toner has been charged, is applied to the first transferring unit 60. Note that, during this process, the photoconductor 20 and the intermediate transferring member 70 are placed in contact with each other, but the second transferring unit 80 is kept separated from the intermediate transferring member 70.

By subsequently performing the above-mentioned processes for the second, the third, and the fourth colors using each of the developing devices, toner images in four colors corresponding to the respective image signals are transferred onto the intermediate transferring member 70 in a superimposed manner. As a result, a full-color toner image is formed on the intermediate transferring member 70.

With the rotation of the intermediate transferring member 70, the full-color toner image formed on the intermediate transferring member 70 reaches a second transferring position, and is transferred onto a medium by the second transferring unit 80. Note that the medium is transported from the paper supply tray 92 to the second transferring unit 80 via a paper-feed roller 94 and resisting rollers 96. Further, during transferring operations, a second transferring voltage is applied to the second transferring unit 80 and also the unit 80 is pressed against the intermediate transferring member 70.

The full-color toner image transferred onto the medium is heated and pressurized by the fusing unit 90 and fused to the medium.

On the other hand, after the photoconductor 20 passes the first transferring position, the toner adhering to the surface of the photoconductor 20 is scraped off by the cleaning blade 76 that is supported on the cleaning unit 75, and the photoconductor 20 is prepared for electrical charging for forming the next latent image. The scraped-off toner is collected in a remaining-toner collector of the cleaning unit 75.

Overview of Control Unit

Next, a configuration of the control unit 100 is described with reference to FIG. 2. The main controller 101 of the control unit 100 is electrically connected to a host computer via the interface 112, and is provided with an image memory 113 for storing the image signals that have been input from the host computer. The unit controller 102 is electrically connected to the units in the body of the apparatus (i.e., the charging unit 30, the exposing unit 40, the YMCK developing unit 50, the first transferring unit 60, the cleaning unit 75, the second transferring unit 80, the fusing unit 90, and the displaying unit 95), and it detects the state of each unit by receiving signals from sensors provided in those units, and controls the units based on the signals that are input from the main controller 101.

Configuration Example of Developing Device

Figure 3:
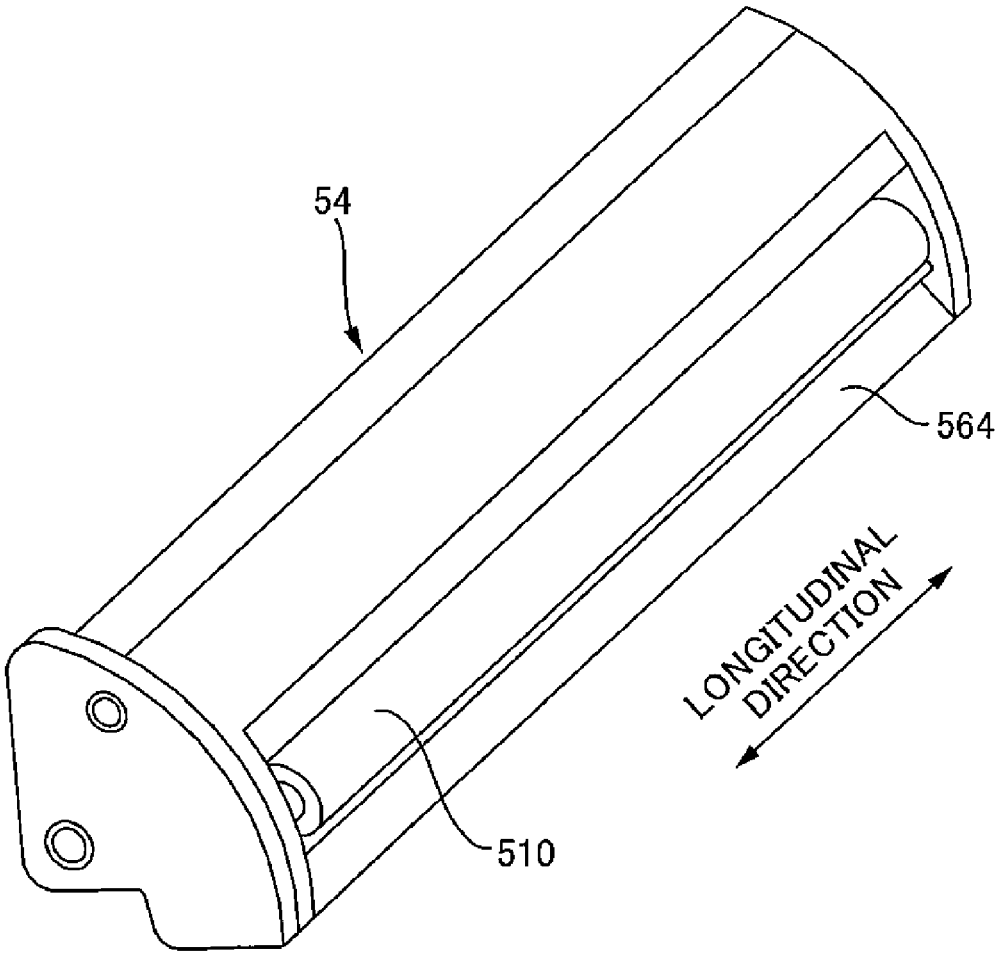
FIG. 3 is a conceptual diagram of a developing device.
Figure 4:
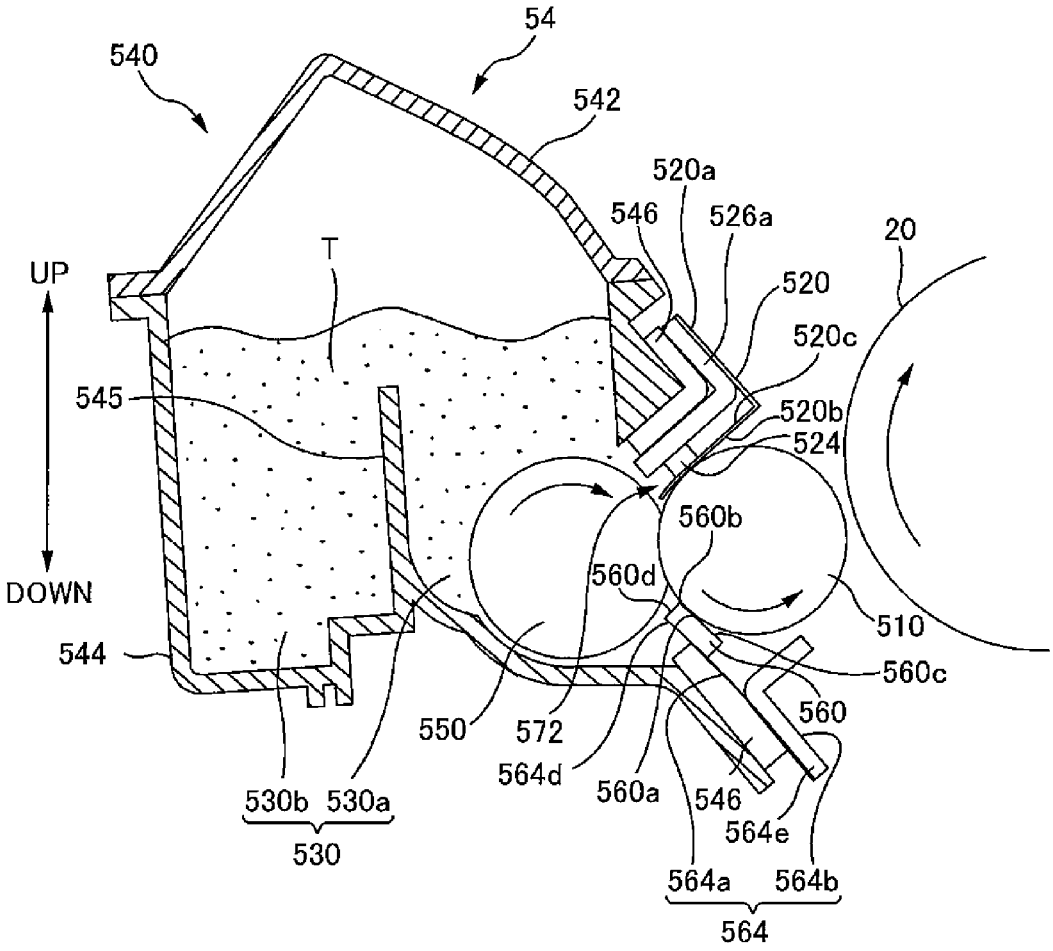
FIG. 4 is a sectional view showing main structural components of the developing device.
Figure 5:
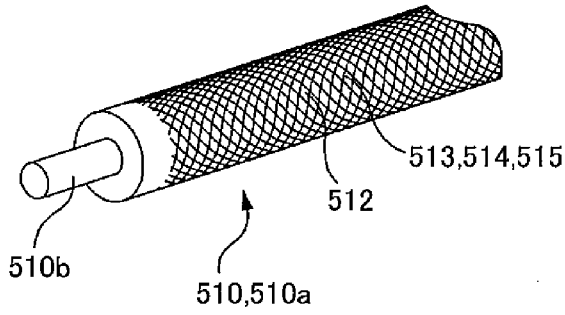
FIG. 5 is a schematic perspective view of a developing roller 510.
Figure 6:
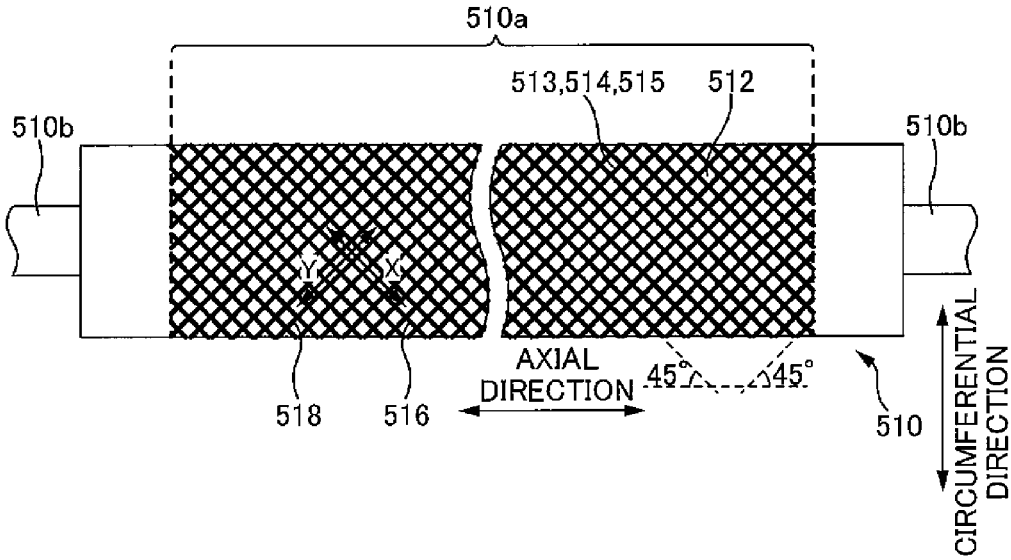
FIG. 6 is a schematic front view of the developing roller 510.
Figure 7:
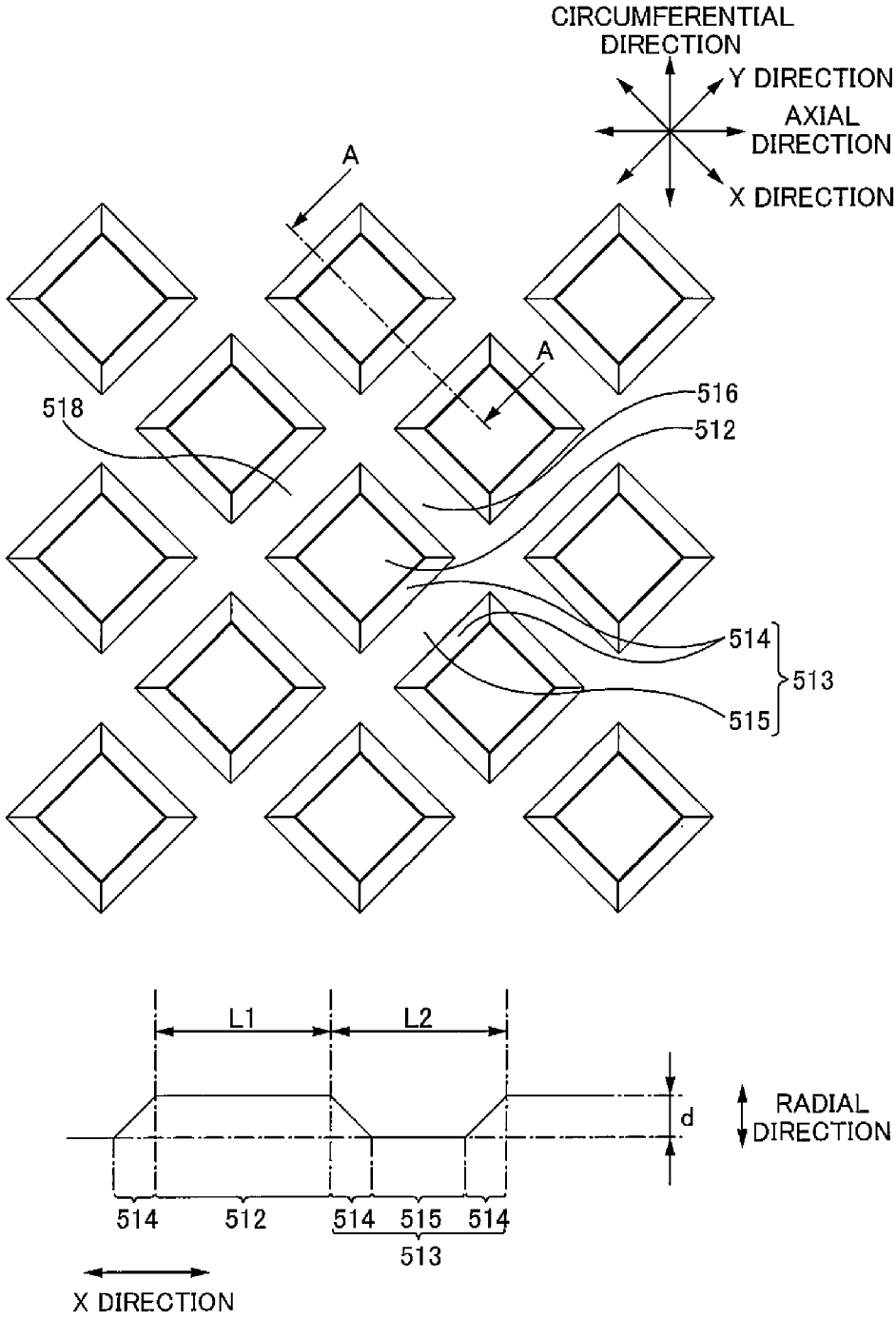
FIG. 7 is a schematic diagram showing the shapes of projecting sections 512, depressed sections 515, etc.
Figure 8:
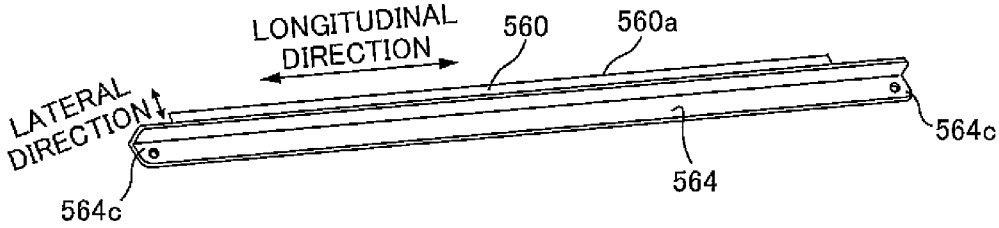
FIG. 8 is a perspective view of a regulation blade 560 and a blade-supporting member 564.
Figure 9:
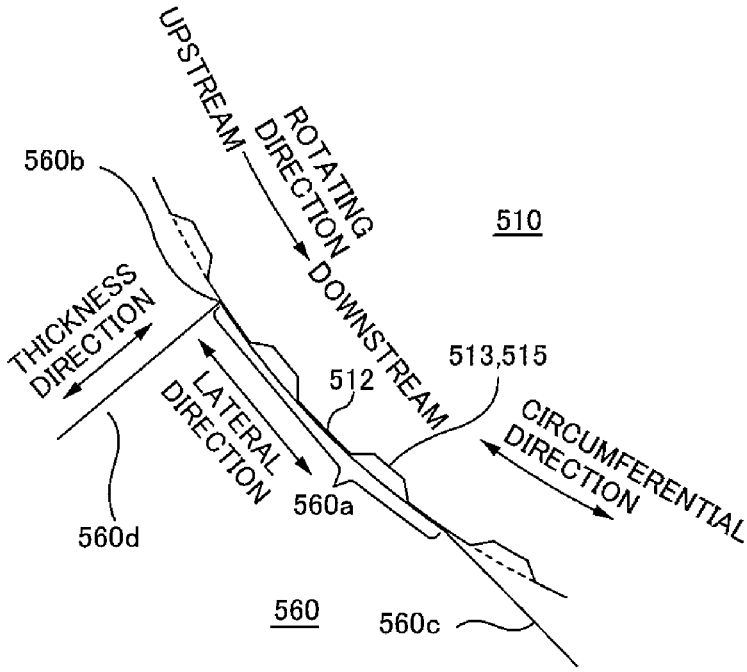
FIG. 9 is an enlarged schematic diagram showing a state around the periphery of a tip edge **560*b* of the regulation blade 560 abutting against the developing roller 510**.
Figure 10:
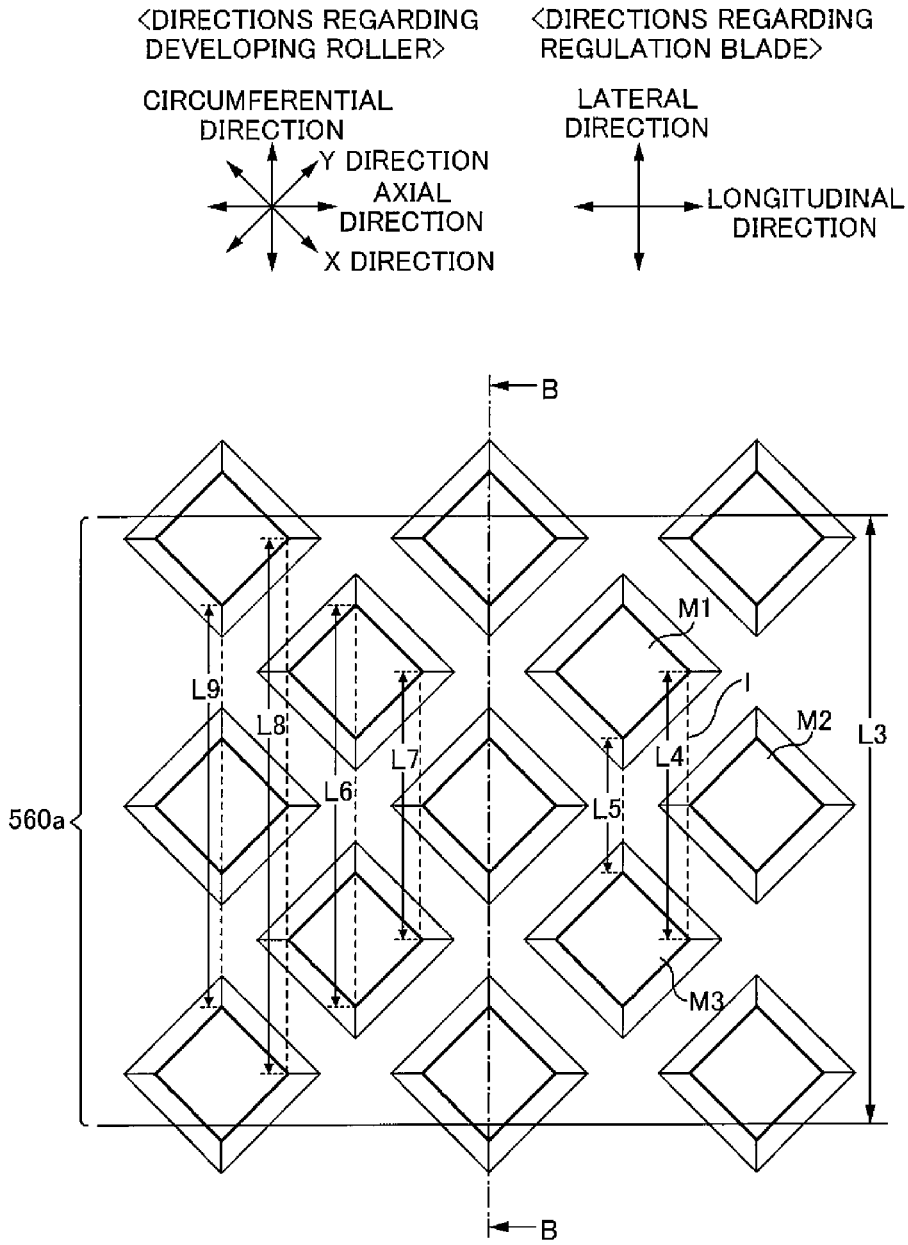
FIG. 10 is a schematic diagram showing a relative positional relationship between an abutment nip **560*a* of the regulation blade 560 and the projecting sections 512 and non-projecting sections 513 of the developing roller 510**.
Figure 11:
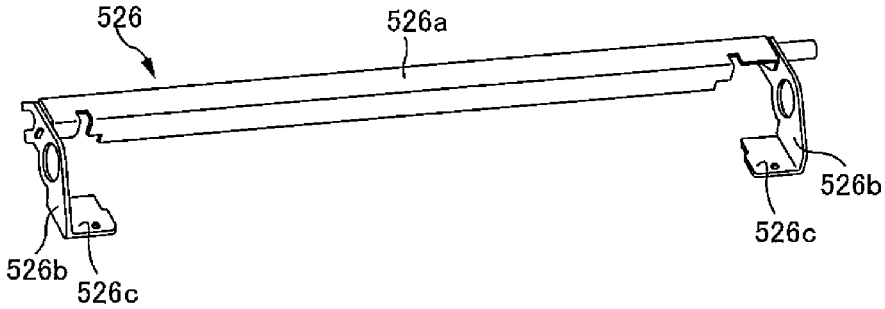
FIG. 11 is a perspective view of a holder 526.
Figure 12:
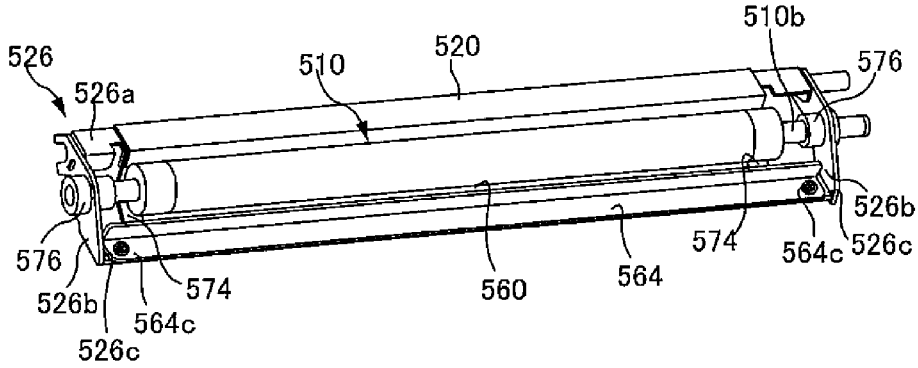
FIG. 12 is a perspective view showing how an upper seal 520, the developing roller 510, the regulation blade 560, and the blade-supporting member 564 are assembled onto the holder 526.
Figure 13:
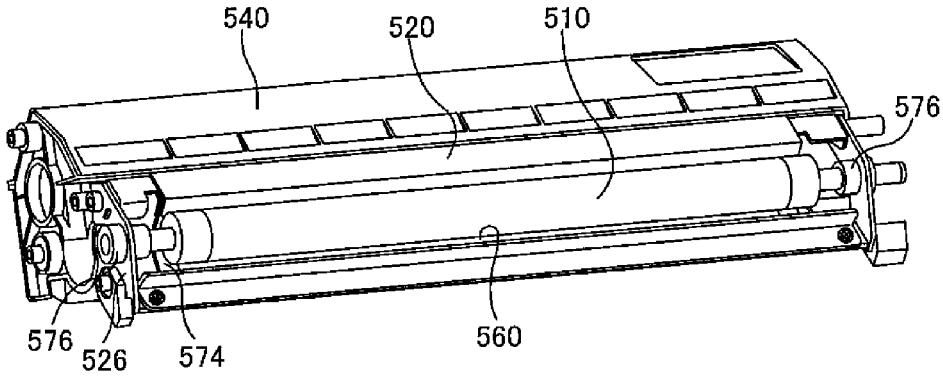
FIG. 13 is a perspective view showing how the holder 526 is mounted onto a housing 540.

Next, a configuration example of the developing device is described with reference to FIGS. 3 to 13. FIG. 3 is a conceptual diagram of a developing device. FIG. 4 is a sectional view showing main structural components of the developing device. FIG. 5 is a schematic perspective view of a developing roller 510. FIG. 6 is a schematic front view of the developing roller 510. FIG. 7 is a schematic diagram showing the shapes of projecting sections 512, depressed sections 515, etc., wherein the lower diagram of FIG. 7 shows the sectional shape along the cross-section A-A of the upper diagram of FIG. 7. FIG. 8 is a perspective view of a regulation blade 560 and a blade-supporting member 564. FIG. 9 is an enlarged schematic diagram (conceptual diagram) showing a state around the periphery of a tip edge 560*b* of the regulation blade 560 abutting against the developing roller 510. FIG. 10 is a schematic diagram (conceptual diagram) showing the relative positional relationship between an abutment nip 560*a* of the regulation blade 560 and the projecting sections 512 and non-projecting sections 513 of the developing roller 510. FIG. 11 is a perspective view of a holder 526. FIG. 12 is a perspective view showing how an upper seal 520, the developing roller 510, the regulation blade 560, and the blade-supporting member 564 are assembled onto the holder 526. FIG. 13 is a perspective view showing how the holder 526 is mounted onto a housing 540. Note that the sectional view of FIG. 4 shows a cross-section of the developing device cut away along a plane perpendicular to the longitudinal direction shown in FIG. 3. Further, in FIG. 4, the vertical direction is shown by the arrow as in FIG. 1, and for example, the central axis of the developing roller 510 is below the central axis of the photoconductor 20. Furthermore, in FIG. 4, the yellow developing device 54 is shown to be in a state where it is positioned at the developing position in opposition to the photoconductor 20. Further, FIG. 9 corresponds to cross-section B-B of FIG. 10. Furthermore, in FIGS. 5 to 7, 9, and 10, the scale of the projecting sections 512 etc. differs from the actual scale for the sake of clarity of the figures. Further, the arrows in FIG. 8 respectively indicate the longitudinal and lateral directions of the regulation blade 560, and the arrows in FIG. 9 respectively indicate the lateral and thickness directions of the regulation blade 560.

The YMCK developing unit 50 is provided with a black developing device 51 containing black (K) toner, a magenta developing device 52 containing magenta (M) toner, a cyan developing device 53 containing cyan (C) toner, and a yellow developing device 54 containing yellow (Y) toner. Since the configuration of each developing device is the same, the yellow developing device 54 will be described below.

The yellow developing device 54 has, for example, a developing roller 510 as an example of a toner bearing roller, an upper seal 520, a toner containing member 530, a housing 540, a toner supplying roller 550, a regulation blade 560, and a holder 526.

The developing roller 510 bears toner T, transports the toner by rotating to the developing position which is in opposition to the photoconductor 20, and develops the latent image borne on the photoconductor 20 with the toner T (the toner T borne on the developing roller 510). The developing roller 510 is a component made, for example, of aluminum alloy or iron alloy.

The developing roller 510 has projecting sections 512 and non-projecting sections 513 on the surface of its central section 510*a*. The non-projecting sections 513 include side sections 514 and depressed sections 515. As shown in FIGS. 5 to 7, the projecting and non-projecting sections are arranged regularly on the surface of the developing roller 510.

The projecting sections 512 are the highest sections within the central section 510*a*, and as shown in the upper diagram of FIG. 7, each has a flat, square-shaped top surface. The length L1 of each side of the square-shaped projecting section 512 (refer to the lower diagram of FIG. 7) is approximately 50 μm. The projecting section 512 is formed on the surface of the central section 510*a* in such a manner that the two diagonals of the square are along the rotation-axis direction and the circumferential direction of the developing roller 510, respectively.

In this embodiment, the non-projecting sections 513 are made of first groove sections 516 and second groove sections 518 whose winding directions differ from one another. The first groove section 516 is a helical groove whose longitudinal direction is along the direction indicated by the symbol X in FIG. 6, whereas the second groove section 518 is a helical groove whose longitudinal direction is along the direction indicated by the symbol Y in FIG. 6. Note that, for either of the groove sections, the acute angle formed between the longitudinal direction of the groove section and the rotation-axis direction of the developing roller 510 is approximately 45° (refer to FIG. 6). Further, the groove width L2 of the groove section (in other words, the distance between adjacent projecting sections 512; refer to the lower diagram of FIG. 7) is approximately 50 μm, as with the length L1 of each side of the projecting section 512.

The side section 514 is a slanted surface that connects the projecting section 512 and the depressed section 515, and as shown in the upper diagram of FIG. 7, there are four side sections 514 respectively corresponding to the sides of the square-shaped projecting section 512 described above. Further, as shown in FIGS. 5 to 7, a multitude of (sets of) the projecting section 512 and the four side sections 514 are arranged regularly in a meshed manner on the surface of the central section 510*a* of the developing roller 510.

The depressed section 515 corresponds to the bottom section of the non-projecting section 513 (i.e., the first groove section 516 or the second groove section 518), and is the lowest section within the central section 510*a*. As shown in FIGS. 5 to 7, the depressed sections 515 are formed regularly in a net-like manner so as to surround the four sides of the projecting section 512 and the four side sections 514. Note that, as shown in FIG. 7, the depth d of the depressed section 515 (non-projecting section 513) relative to the projecting section 512 (i.e., the length from the projecting section 512 to the depressed section 515 in the radial direction of the developing roller 510) is approximately 8 μm. The developing roller 510 has the projecting sections 512 and the depressed sections 515 formed thereon in such a manner that the depth d is uniform among all of the depressed sections 515 provided in the developing roller 510. In this embodiment, the toner T is granular (particulate), and the volume average particle diameter of the toner T is approximately 4.6 μm. Thus, the size of the volume average particle diameter of the toner T is smaller than the depth d of the depressed section 515.

Furthermore, the surface of the central section 510*a*, which is provided with the projecting sections 512, the side sections 514, and the depressed sections 515, is plated with electroless Ni—P plating.

Further, the developing roller 510 has a shaft section 510*b*, and the developing roller 510 is rotatably supported due to the shaft section 510*b* being supported, via bearings 576, by developing-roller supporting sections 526*b* of a holder 526 described further below (see FIG. 12). As shown in FIG. 4, the developing roller 510 rotates in a direction (the counterclockwise direction in FIG. 4) opposite from the rotating direction of the photoconductor 20 (the clockwise direction in FIG. 4).

Further, there is a gap between the developing roller 510 and the photoconductor 20 in a state where the yellow developing device 54 is in opposition to the photoconductor 20. That is, the yellow developing device 54 develops the latent image formed on the photoconductor 20 in a contactless state in which the toner T borne on the developing roller 510 is not in contact with the photoconductor 20.

The housing 540 is manufactured by welding together a plurality of integrally-molded housing sections made of resin—that is, an upper housing section 542 and a lower housing section 544. In the housing 540, a toner containing member 530 is formed for containing the toner T. The toner containing member 530 is divided into two toner containing sections, namely, the first toner containing section 530*a* and the second toner containing section 530*b*, by a partitioning wall 545 that is for partitioning the toner T and that protrudes inward (in the up/down direction of FIG. 4) from the inner wall. The first toner containing section 530*a* and the second toner containing section 530*b* are connected at their upper sections, and in the state shown in FIG. 4, movement of the toner T is restricted by the partitioning wall 545. Further, as shown in FIG. 4, the housing 540 (more specifically, the first toner containing section 530*a*) has an opening 572 in its lower section, and the developing roller 510 is provided facing the opening 572.

The toner supplying roller 550 is provided in the first toner containing section 530*a* described above and supplies the toner T contained in the first toner containing section 530*a* to the developing roller 510. The toner supplying roller 550 is made, for example, of polyurethane foam, and abuts against the developing roller 510 in an elastically deformed state. The toner supplying roller 550 is rotatable about its central axis, and by rotating, it transports the toner T to an abutting position where the roller 550 abuts against the developing roller 510. Then, at the abutting position, the toner T is frictionally charged by the toner supplying roller 550 and the developing roller 510, and the electrically-charged toner T adheres to the developing roller 510 and is appropriately borne on the developing roller 510. In this way, the toner supplying roller 550 supplies the toner T to the developing roller 510.

Note that the toner supplying roller 550 rotates in a direction (clockwise in FIG. 4) opposite from the rotating direction of the developing roller 510 (counterclockwise in FIG. 4). Further, the toner supplying roller 550 not only serves to supply the toner T to the developing roller 510, but it also serves to strip off, from the developing roller 510, the toner T remaining on the developing roller 510 after development.

The upper seal 520 abuts against the developing roller 510 along the rotation-axis direction thereof to allow the toner T remaining on the developing roller 510 after passing the developing position to move into the housing 540 and also to restrict the toner T in the housing 540 from moving outside therefrom. The upper seal 520 is a seal made, for example, of polyethylene film. The upper seal 520 is supported by an upper-seal supporting section 526*a* of the holder 526 described below, and it is arranged in such a manner that its longitudinal direction is along the rotation-axis direction of the developing roller 510 (see FIG. 12).

Further, in between the upper-seal supporting section 526*a* and a surface of the upper seal 520 (which is also referred to as the opposite surface 520*c*) on the opposite side from the abutting surface 520*b* of the upper seal 520 with which it abuts against the developing roller 510, there is provided an upper-seal urging member 524 made of an elastic body, such as Moltoprene, in a compressed state. The upper-seal urging member 524 presses the upper seal 520 against the developing roller 510 by urging the upper seal 520 toward the developing roller 510 with its urging force.

The regulation blade 560 abuts against the developing roller 510 in such a manner that the longitudinal direction of the regulation blade 560 is along the rotation-axis direction of the developing roller 510 over the range extending from one end to the other end, in the rotation-axis direction, of the developing roller 510, and regulates the amount of toner T borne on the developing roller 510 (the projecting sections 512 and the non-projecting sections 513) as well as applies electrical charge to the toner T borne on the developing roller 510.

The regulation blade 560 has a thickness of approximately 2 mm, is made, for example, of silicone rubber or urethane rubber having a rubber hardness of approximately 65 degrees according to JIS-A, and is supported by a blade-supporting member 564 as shown in FIGS. 4 and 8. The blade-supporting member 564 is made up of a thin plate 564*a* and a thin-plate supporting section 564*b*, and supports the regulation blade 560 with one end 564*d* thereof in the lateral direction (i.e., the end on the side of the thin plate 564*a*). The thin plate 564*a* is made, for example, of phosphor bronze or stainless steel having a thickness of approximately 0.15 mm, and has a spring-like characteristic. The thin plate 564*a* directly supports the regulation blade 560, and presses the regulation blade 560 against the developing roller 510 with its urging force. (The linear pressure of the regulation load of the regulation blade 560 is approximately 2.33 g/mm.) The thin-plate supporting section 564*b* is a plate made of metal arranged on the other end 564*e*, in the lateral direction, of the blade-supporting member 564. The thin-plate supporting section 564*b* is attached to the thin plate 564*a* in a state where the section 564*b* supports an end of the thin plate 564*a* on the opposite side from the side supporting the regulation blade 560. Further, the regulation blade 560 and the blade-supporting member 564 are attached to the regulation-blade supporting sections 526*c* of the holder 526 described below in a state where both ends 564*c*, in the longitudinal direction, of the thin-plate supporting section 564*b* are supported by the regulation-blade supporting sections 526*c*.

As shown in FIG. 9, the regulation blade 560 abuts, with a predetermined width, against the circumferential surface of the developing roller 510 in the circumferential direction. In other words, the regulation blade 560 has formed thereon an abutting section (also referred to below as an abutment nip 560*a*) having a predetermined width (also referred to below as a regulation nip width).

Further, the tip edge 560*b*, in the lateral direction and the thickness direction, of the regulation blade 560 is located within the abutment nip 560*a* having the above-mentioned predetermined width. That is, the tip edge 560*b* abuts against the developing roller 510. This regulation style of the regulation blade 560 is the so-called edge regulation.

Note that, as shown in FIGS. 4 and 9, the regulation blade 560 has a rectangular sectional shape and is provided with a first surface 560*c* along the lateral direction and a second surface 560*d* along the thickness direction. In this embodiment, the abutment nip 560*a* is provided on the first surface 560*c* of the two surfaces, and the tip edge 560*b* is located at one end, in the lateral direction, of the abutment nip 560*a*. Further, the regulation blade 560 is arranged in such a manner that its tip edge 560*b* faces toward the upstream side in the rotating direction of the developing roller 510. That is, the regulation blade 560 makes a so-called counter-abutment with respect to the roller 510.

Further, in the case of considering the size of the regulation nip width of the abutment nip 560*a* (in the circumferential direction) as compared to the size of the width of the non-projecting section 513 etc. in the circumferential direction, the regulation nip width (indicated by the symbol L3 in FIG. 10) is larger than the maximum width, in the circumferential direction, of the non-projecting section 513, as shown in FIG. 10.

As shown in FIG. 10, the width, in the circumferential direction, of the non-projecting section 513 differs depending on the position of the non-projecting section 513 in the rotation-axis direction. (For example, the width indicated by the symbol L4 and the width indicated by the symbol L5 are different.) The regulation nip width is larger than the largest width among the various widths that differ from one another, i.e., the maximum width. In other words, in this embodiment, the regulation nip width is larger than the width, in the circumferential direction, of the non-projecting section 513 over the range extending from one end to the other end, in the longitudinal direction, of the regulation blade 560. In this embodiment, the regulation nip width is approximately 300 μm, whereas the maximum width, in the circumferential direction, of the non-projecting section 513 is the width indicated by the symbol L4 and is approximately 141.4 μm (twice the value obtained by multiplying fifty by the square root of two). (Note that the width indicated by the symbol L4 is not the length of a line segment from the right end of the projecting section 512 indicated by the symbol M1 to the right end of the projecting section 512 indicated by the symbol M3 passing the left end of the projecting section 512 indicated by the symbol M2, but is the length of a line segment 1 which is slightly to the left of the above-mentioned line segment. That is, the line segment 1 is not on the left end of the projecting section 512 indicated by the symbol M2.) Incidentally, the width indicated by the symbol L5 is the minimum width, in the circumferential direction, of the non-projecting section 513 and is approximately 70.7 μm (a value obtained by multiplying fifty by the square root of two).

Furthermore, the regulation nip width according to this embodiment is sufficiently larger than the width, in the circumferential direction, of the non-projecting section 513. More specifically, the regulation nip width is larger than the sum of the width, in the circumferential direction, of the non-projecting section 513 and a value twice the width, in the circumferential direction, of the projecting section 512 over the range extending from one end to the other end, in the longitudinal direction, of the regulation blade 560. (This sum is also referred to below as a first sum.) The magnitude of the first sum also differs depending on the position in the rotation-axis direction. (For example, the first sum indicated by the symbol L6 and the first sum indicated by the symbol L7 are different.) However, regardless of the position, the regulation nip width is larger than the first sum. (Note that the maximum first sum is the sum indicated by the symbol L6 and is approximately 212.1 μm.) Further, the regulation nip width is larger than the sum of a value twice the width, in the circumferential direction, of the non-projecting section 513 and the width, in the circumferential direction, of the projecting section 512 over the range extending from one end to the other end, in the longitudinal direction, of the regulation blade 560. (This sum is also referred to below as a second sum.) The magnitude of the second sum also differs depending on the position in the rotation-axis direction. (For example, the second sum indicated by the symbol L8 and the second sum indicated by the symbol L9 are different.) However, regardless of the position, the regulation nip width is larger than the second sum. (Note that the maximum second sum is the sum indicated by the symbol L8 and is approximately 282.8 μm.)

Further, as shown in FIG. 12, end seals 574 are provided on the outer sides, in the longitudinal direction, of the regulation blade 560. The end seals 574 are made of nonwoven fabric and contacts with the ends, in the rotation-axis direction, of the developing roller 510 along the circumferential surface of the developing roller 510, to thereby serve to prevent the toner T from spilling from between the circumferential surface of the roller and the housing 540.

The holder 526 is a component made of metal for assembling thereon various components such as the developing roller 510. As shown in FIG. 11, the holder 526 has: an upper-seal supporting section 526*a* along the longitudinal direction (i.e., the rotation-axis direction of the developing roller 510); developing-roller supporting sections 526*b* that are provided on the outer sides of the upper-seal supporting section 526*a* in the longitudinal direction (the rotation-axis direction) and that intersect with the longitudinal direction (the rotation-axis direction); and regulation-blade supporting sections 526*c* that intersect with the developing-roller supporting sections 526*b* and that are located in opposition to the ends, in the longitudinal direction, of the upper-seal supporting section 526*a*.

As shown in FIG. 12, the upper seal 520 is supported by the upper-seal supporting section 526*a* at its end 520*a* in the lateral direction (see FIG. 4), and the developing roller 510 is supported by the developing-roller supporting sections 526*b* at its ends.

Furthermore, the regulation blade 560 and the blade-supporting member 564 are supported by the regulation-blade supporting sections 526*c* at both ends 564*c*, in the longitudinal direction, of the blade-supporting member 564. The regulation blade 560 and the blade-supporting member 564 are fixed to the holder 526 by being screwed onto the regulation-blade supporting sections 526*c*.

The holder 526 having the upper seal 520, the developing roller 510, the regulation blade 560, and the blade-supporting member 564 assembled thereto in this way is attached to the above-mentioned housing 540 via a housing seal 546 (see FIG. 4) for preventing the toner T from spilling from between the holder 526 and the housing 540, as shown in FIG. 13.

In the yellow developing device 54 structured as described above, the toner supplying roller 550 supplies the toner T contained in the toner containing member 530 to the developing roller 510. At the time of being supplied, the toner T is frictionally charged by the toner supplying roller 550 and the developing roller 510, and the electrically-charged toner T adheres to the developing roller 510 and is appropriately borne on the developing roller 510. With the rotation of the developing roller 510, the toner T borne on the developing roller 510 reaches the regulation blade 560, and the regulation blade 560 regulates the amount of the toner T and also frictionally charges the toner T even further. With further rotation of the developing roller 510, the toner T on the developing roller 510 reaches the developing position opposing the photoconductor 20. Then, under the alternating field, the toner T is used at the developing position for developing the latent image formed on the photoconductor 20. With further rotation of the developing roller 510, the toner T on the developing roller 510, which has passed the developing position, passes the upper seal 520 and is collected into the developing device by the upper seal 520 without being scraped off. Further, the toner T that still remains on the developing roller 510 can be stripped off by the toner supplying roller 550.

Reason for Adopting Edge Regulation in Printer 10 According to Present Embodiment As described in the "Related Art" section above, the so-called non-edge regulation (or flat-region-abutment regulation; a regulation style in which the tip edge 560*b*, in the lateral direction and the thickness direction, of the regulation blade 560 is not located within the abutment nip 560*a* having the above-mentioned predetermined width) is well known as the style (mode) according to which the regulation blade 560 performs regulation. There are cases, however, in which it is effective to adopt the so-called edge regulation (a regulation style in which the tip edge 560*b*, in the lateral direction and the thickness direction, of the regulation blade 560 is located within the abutment nip 560*a* having the above-mentioned predetermined width) from the viewpoint of curbing occurrence of development memory (development hysteresis), for example. Further, there is a certain relationship between the constitution of the toner and the degree at which development memory occurs, and therefore, the degree at which development memory occurs differs depending on the constitution of the toner used in the printer 10. Therefore, in cases where toner having characteristics that significantly cause development memory is used, it is desirable to curb the occurrence of development memory by adopting edge regulation.

The toner according to this embodiment has such characteristics that significantly cause development memory, and therefore, in this embodiment, edge regulation is adopted in order to curb the occurrence of development memory.

Below, a mechanism according to which development memory occurs is described first. Next, the constitution of the toner according to this embodiment is described, and then the reason why such toner significantly causes development memory is described. Further, the reason why it is possible to curb the occurrence of development memory by adopting edge regulation is described next. These descriptions will reveal the reason for adopting edge regulation in the printer 10 according to this embodiment.

Mechanism According to which Development Memory Occurs

Figure 14:
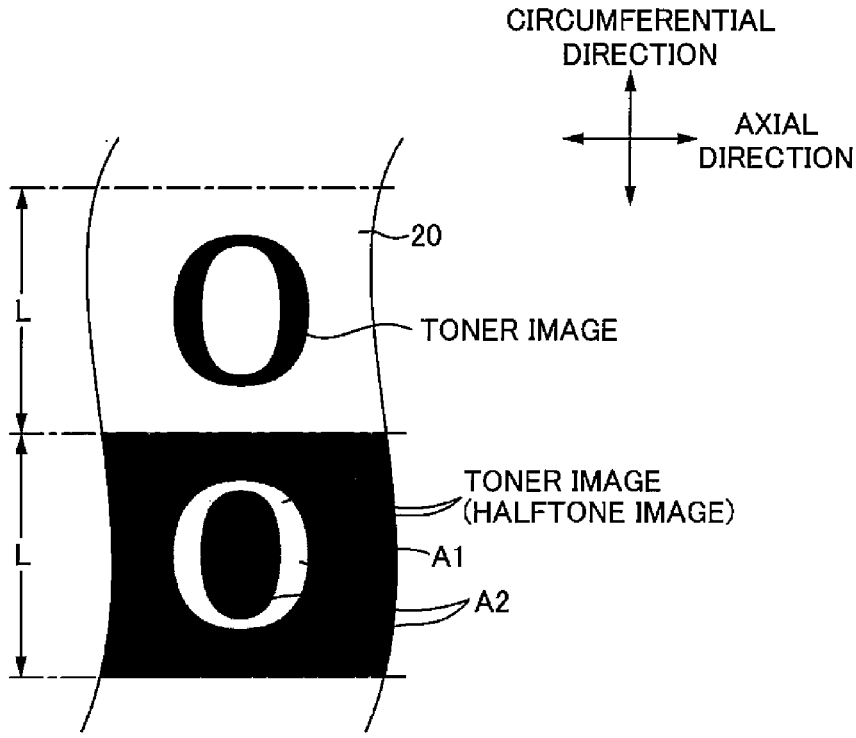
FIG. 14 is an explanatory diagram for describing a mechanism according to which development memory occurs.

In this section, a mechanism according to which development memory occurs is described with reference to FIG. 14. FIG. 14 is an explanatory diagram for describing a mechanism according to which development memory occurs.

As described above, toner is frictionally charged by the toner supplying roller 550 and the developing roller 510, and the electrically-charged toner adheres to the developing roller 510 and is borne on the developing roller 510. Then, the toner borne on the developing roller 510 is frictionally charged even further by the regulation blade 560, and then reaches the developing position in opposition to the photoconductor 20 and is used for developing a latent image at the developing position. That is, in the case where the developing roller 510 makes one revolution, the following processes are executed: a process of charging and supplying the toner by the toner supplying roller 550 (a process of causing the toner to be borne on the developing roller 510); a process of charging the toner by the regulation blade 560; and a process of developing the latent image on the photoconductor 20. This series of processes is executed a plurality of times as the developing roller 510 makes a plurality of times of revolutions. Further, for example, a toner image formed on the photoconductor 20 by executing the above-mentioned series of processes for the $n^{th}$ revolution of the developing roller 510 and a toner image formed on the photoconductor 20 by executing the above-mentioned series of processes for the $n+1^{st}$ revolution of the developing roller 510 will be in such a state that the toner images are located side-by-side in the circumferential direction on the photoconductor 20.

In this section, consideration is made regarding the above-mentioned processes of the developing roller 510, assuming that a latent image representing the alphabet "O" is developed and a toner image representing the alphabet "O" is formed on the photoconductor 20 by executing the above-mentioned series of processes for the $n^{th}$ revolution of the developing roller 510, and a latent image is developed and a halftone image is formed on the entire surface of the photoconductor 20 by executing the above-mentioned series of processes for the $n+1^{st}$ revolution of the developing roller 510. Through this consideration, the mechanism according to which development memory occurs is revealed.

When the latent image representing the alphabet "O" is developed in the development process for the $n^{th}$ revolution of the developing roller 510, the toner—among all the toner borne on the developing roller 510—that is borne on a section of the developing roller 510 opposing the latent image is consumed for forming the toner image. Thus, after the development process for the $n^{th}$ revolution of the developing roller 510 is finished, the opposing section will be in such a state that no toner is borne thereon. On the other hand, the toner that is borne on a section of the developing roller 510 not opposing the latent image is not consumed. Therefore, even after the development process is finished, the toner will still be borne on the non-opposing section. In this way, after the above-mentioned series of processes for the $n^{th}$ revolution of the developing roller 510 is finished, a first region having no toner borne thereon (this first region will be in the shape of the letter "O") and a second region having toner borne thereon will be created on the developing roller 510.

Then, as the developing roller 510 rotates, the first and second regions eventually reach the abutting position where the roller 510 abuts against the toner supplying roller 550, and the above-mentioned series of processes for the n+1$^{st}$ revolution of the developing roller 510 is started. More specifically, at the abutting position, the process of charging and supplying the toner by the toner supplying roller 550 for the n+1$^{st}$ revolution is executed.

It should be noted here that the second region already has toner borne thereon, and the toner is in a sufficiently-charged state due to execution of the process of charging and supplying the toner by the toner supplying roller 550 for the n$^{th}$ revolution and the process of charging the toner by the regulation blade 560 for the n$^{th}$ revolution. Further, since the toner is charged even further by execution of the present process, the adhesive force with which the toner adheres to the developing roller 510 is enhanced even further. Thus, the toner is transported toward the regulation blade 560 for execution of the subsequent process while being kept borne on the developing roller 510.

On the other hand, the first region has no toner borne thereon, and therefore, toner contained in the toner containing member 530 is supplied anew to the first region. It should be noted here that the electrical charge of this toner is still in an insufficient state, in contrast to the toner in the second region which has been sufficiently charged by execution of the processes of charging the toner for the n$^{th}$ revolution. Further, the toner is frictionally charged by the toner supplying roller 550 and the developing roller 510 in the present process, but in cases where the toner has characteristics in which the buildup of the electrical charge of the toner is slow (it takes time for the electrical-charge amount to reach the saturation electrical-charge amount), the toner is not appropriately borne on the developing roller 510 at the time frictional charging is carried out (in other words, the toner is not sufficiently supplied by the toner supplying roller 550 in the first region).

Then, the first region on which the toner is not borne appropriately and the second region on which the toner is borne appropriately first reach the regulation blade 560 for execution of the process of charging the toner by the regulation blade 560 for the n+1$^{st}$ revolution, and then reach the developing position in opposition to the photoconductor 20. Here, the development process for the n+1$^{st}$ revolution is executed and the latent image is developed, and thus a halftone image is formed on the entire surface of the photoconductor 20. However, the first region does not bear the toner appropriately, even though the second region bears the toner appropriately. Therefore, the darkness of the halftone image formed by developing the latent image in opposition to the first region becomes lighter than the darkness of the halftone image formed by developing the latent image in opposition to the second region.

This state (in which there is difference between the darkness of the two images) is shown in FIG. 14. FIG. 14 shows the toner image representing the alphabet "O" formed on the photoconductor 20 by executing the above-mentioned series of processes for the n$^{th}$ revolution of the developing roller 510, and the halftone image formed on the photoconductor 20 by executing the above-mentioned series of processes for the n+1$^{st}$ revolution of the developing roller 510. This figure shows the toner images, which are formed on the photoconductor 20, on the circumferential surface of a schematically-developed photoconductor 20, and indicates the circumferential direction and the axial direction of the photoconductor 20 with the respective arrows. The length L shown in the figure corresponds to the length of one revolution of the circumferential surface of the developing roller 510.

Further, FIG. 14 shows a state in which the darkness of the halftone image formed by developing the latent image in opposition to the first region (indicated by the character A1 in the figure) is lighter than the darkness of the halftone image formed by developing the latent image in opposition to the second region (indicated by the character A2 in the figure). Further, as described above, since the first region has the shape of the letter "O", the halftone image lighter in darkness—which is formed by developing the latent image in opposition to the first region—also has the shape of the letter "O". That is, a phenomenon, i.e., development memory, occurs in which the shape of the toner image formed on the photoconductor 20 by executing the above-mentioned series of processes for the n$^{th}$ revolution appears in the halftone image formed on the photoconductor 20 by executing the above-mentioned series of processes for the n+1$^{st}$ revolution.

In this way, in cases where toner having a slow electrical-charge buildup is used in the printer 10, development memory may occur significantly due to this slow electrical-charge buildup.

Conversely, in cases where toner having a fast electrical-charge buildup is used, the developing roller 510 will appropriately bear the toner also in the first region at the time the toner is frictionally charged by the toner supplying roller 550 and the developing roller 510 during the process of charging and supplying the toner for the n+1$^{st}$ revolution. Thus, the darkness of the halftone image formed by developing the latent image in opposition to the first region will substantially be the same as the darkness of the halftone image formed by developing the latent image in opposition to the second region. Therefore, in this case, occurrence of development memory is curbed.

Toner According to Present Embodiment

This section describes the constitution of the toner according to this embodiment, that is, the toner used in the printer 10 according to this embodiment, and the reason why the toner significantly causes development memory.

Toner Constitution (1) Particle Diameter of Toner

The toner used in the printer 10 according to this embodiment has a smaller toner particle diameter (volume average particle diameter of 5 μm or less) than the particle diameter of toner generally used heretofore (volume average particle diameter of above 5 μm), for placing high importance on achieving superior image quality in finally-obtained images (achieving good reproducibility of dots). More specifically, as described above, the volume average particle diameter Ave thereof is approximately 4.6 μm. Note that the 3σ values—that is, σ value obtained by subtracting a value three times the standard deviation σ in the toner-particle-diameter distribution from the volume average particle diameter Ave (referred to below as "−3σ value" for convenience), and a value obtained by adding a value three times the standard deviation σ in the toner-particle-diameter distribution to the volume average particle diameter (referred to below as "+3σ value" for convenience)—are approximately 2.3 μm and approximately 6.9 μm, respectively.

It should be noted here that the volume average particle diameter is a value calculated as the sum total from i=1 to n of the product of Ri and Pi, in cases where the volume occupancy rate of toner having a particle diameter of Ri (i=1 . . . , n) is Pi (i=1 . . . , n; the sum total from P1 to Pn is one). Further, the above-mentioned standard deviation σ is the square root of the variance, and the variance is a value calculated as the sum total from i=1 to n of the product of Pi and the square of the difference between Ri (i=1 . . . , n) and Ave.

(2) Degree of Circularity of Toner

The toner used in the printer 10 according to this embodiment has a larger degree of circularity (which is close to a perfect circle; degree of circularity of 0.950 or greater) than the degree of circularity of toner generally used heretofore (degree of circularity of less than 0.950), for placing high importance on transferability during the first transfer and the second transfer. More specifically, the degree of circularity thereof is approximately 0.960 to 0.985.

(3) Charge Control Agent (CCA)

The toner used in the printer 10 according to this embodiment does not include any charge control agents (CCA).

Typical methods for manufacturing toner include the pulverization method and the polymerization method. The toner according to this embodiment, however, is manufactured through the polymerization method, because the polymerization method is suitable for manufacturing toner having a small particle diameter and toner having a high degree of circularity. In cases where the polymerization method is employed as the toner manufacturing method, there is a possibility that disadvantages may occur by mixing charge control agents (CCA). Therefore, in this embodiment, no charge control agent (CCA) is included in the toner.

Note that the suspension polymerization method and the emulsion polymerization method, for example, may be given as examples of polymerization methods. With the suspension polymerization method, it is possible to form colored toner particles having a desired particle size by, for example, adding, while stirring, a monomer composition having dissolved/dispersed therein polymerizable monomers, coloring agents (coloring pigments), and mold-release agents as well as other additives—such as dyes, polymerization initiators, and cross-linking agents—as necessary into an aqueous phase including suspension stabilizers (water-soluble high polymers and poorly water-soluble inorganic substances), to thereby form the composition into particles and cause polymerization. With the emulsion polymerization method, it is possible to form colored toner particles having a desired particle size by, for example, dispersing monomers and mold-release agents as well as other agents—such as polymerization initiators and emulsifiers (surfactants)—as necessary into water to thereby cause polymerization, and then adding coloring agents (coloring pigments), flocculants (electrolytes), etc. during the flocculation process.

The toner according to this embodiment is manufactured through the emulsion polymerization method. Described below is a method of manufacturing cyan toner—among the above-mentioned four colors of toners (black toner, magenta toner, cyan toner, and yellow toner)—through the emulsion polymerization method.

First, a monomer mixture including 80 parts by mass of styrene monomer as the monomer, 20 parts by mass of butyl acrylate, and 5 parts by mass of acrylic acid was added into an aqueous solution mixture including 105 parts by mass of water, 1 part by mass of a nonionic emulsifier ("Emulgen 950" from Dai-Ichi Kogyo Seiyaku Co., Ltd.), 1.5 parts by mass of an anionic emulsifier ("Neogen R" from Dai-Ichi Kogyo Seiyaku Co., Ltd.), and 0.55 parts by mass of potassium persulfate as a polymerization initiator, and polymerization was carried out for eight hours at 70° C. while stirring the mixture under a nitrogen gas stream. After the polymerization reaction, the mixture was cooled, and a milk-white resin emulsion having a particle diameter of 0.25 μm was obtained.

Next, 200 parts by mass of the resin emulsion, 20 parts by mass of a polyethylene wax emulsion (from Sanyo Chemical Industries, Ltd.) as a mold-release agent, and 25 parts by mass of phthalocyanine blue as a coloring agent were dispersed into 0.2 l of water including 0.2 parts by mass of sodium dodecylbenzenesulfonate as a surfactant. After adding diethylamine and adjusting the pH to 5.5, 0.3 parts by mass of aluminum sulfate as an electrolyte was added to the mixture while stirring, and then dispersion was carried out by stirring at high speed with a stirring device ("TK homomixer").

Furthermore, 40 parts by mass of styrene monomer, 10 parts by mass of butyl acrylate, and 5 parts by mass of zinc salicylate were added along with 40 parts by mass of water. The mixture was heated to 90° C. while stirring under a nitrogen gas stream as above, hydrogen peroxide solution was added to the mixture, and polymerization was carried out for three hours, to thereby let the particles grow. After termination of the polymerization, the temperature of the mixture was raised to 95° C. while adjusting the pH to 5 or above and the mixture was held in this state for five hours, in order to increase the bonding strength of the aggregated particles. Then, the obtained particles were washed with water and vacuum-dried at 45° C. for ten hours, to thereby obtain cyan-toner core particles (colored toner particles).

The colored toner particles obtained in this way were mixed with external additives (specifically, silica and titania) and thus the external additives were added to the exterior of the colored toner particles, to thereby obtain cyan toner having a volume average particle diameter of approximately 4.6 μm.

(4) Coloring Agents (Coloring Pigments)

As regards the toner used in the printer 10 according to this embodiment, the amount of coloring agent (coloring pigment) included in the toner is larger (i.e., 10 wt % or greater) than the amount of coloring agent (coloring pigment) included in toner generally used heretofore (i.e., less than 10 wt %), in consideration of the fact that the toner particle diameter is small. That is, in cases where the toner particle diameter is small, the amount of toner that ultimately adheres to the medium such as paper becomes small, and therefore, the darkness of the image tends to be light. Therefore, in order to compensate for this, a larger amount of coloring agent (coloring pigment) is included in this embodiment.

Reason why Toner According to Present Embodiment Significantly Causes Development Memory The toner according to this embodiment has the characteristics as described in (1) to (4) above. Due to the fact that the toner has such characteristics, development memory is prone to occur in the printer 10 according to this embodiment in which the above-mentioned toner is used.

More specifically, as the toner particle diameter becomes small, the saturation electrical-charge amount of the toner increases, and thus the electrical-charge buildup of the toner becomes slow. Further, since the toner does not include any charge control agents (CCA), it is not possible to employ charge control for accelerating the electrical-charge buildup of the toner. Further, since the amount of coloring agent (coloring pigment) is large, the electrical-charge buildup of the toner inevitably becomes slow.

Thus, due to the electrical-charge buildup of the toner being slow, development memory is prone to occur in the printer 10 according to this embodiment.

Further, in cases where the degree of circularity of the toner is small, it is likely that the toner will get caught by the developing roller 510, and therefore, the above-mentioned inappropriateness regarding the toner borne in the first region is somewhat reduced, even if the electrical-charge buildup of the toner is slow. Thus, the difference between the darkness of the halftone image formed by developing the latent image in opposition to the first region and the darkness of the halftone image formed by developing the latent image in opposition to the second region is further reduced, and thereby the occurrence of development memory is somewhat curbed. However, since the degree of circularity of the toner according to this embodiment is high, it is not possible to expect such an effect. Therefore, the occurrence of development memory is more significant in this embodiment.

Effect of Curbing Development Memory by Edge Regulation

As described above, the toner according to this embodiment has characteristics that significantly cause development memory. Therefore, the printer 10 according to this embodiment adopts edge regulation in order to curb the occurrence of development memory.

This section describes the reason why the occurrence of development memory is appropriately curbed in the printer 10 according to this embodiment—that is, the reason why the occurrence of development memory is appropriately curbed by adopting edge regulation as the regulation style of the regulation blade 560.

As described above, the toner is frictionally charged by the toner supplying roller 550 and the developing roller 510, and the electrically-charged toner adheres to the developing roller 510 and is borne on the developing roller 510. Then, with the rotation of the developing roller 510, the toner borne on the developing roller 510 reaches the regulation blade 560, and the regulation blade 560 regulates the amount of the toner and also frictionally charges the toner even further.

It should be noted here that in this embodiment, edge regulation is employed as the regulation style of the regulation blade 560. More specifically, as shown in FIG. 9, the tip edge 560*b*, in the lateral direction and the thickness direction, of the regulation blade 560 is located within the abutment nip 560*a* having the above-mentioned predetermined width (i.e., the tip edge 560*b* abuts against the developing roller 510). Therefore, at the time the toner borne on the projecting sections 512 reaches the regulation blade 560 with the rotation of the developing roller 510, the toner on the projecting sections 512 is struck by the tip edge 560*b* and is flicked off, and therefore cannot reach the developing position in opposition to the photoconductor 20.

Now, attention is focused on the toner borne on the depressed sections 515. The volume average particle diameter of the toner (approximately 4.6 μm) is smaller than the depth d (approximately 8 μm) of the depressed section 515 (the non-projecting section 513). Therefore, the toner borne on the depressed sections 515 is appropriately prevented from being struck by the tip edge 560*b*, and can thus reach the developing position in opposition to the photoconductor 20.

Figure 15:
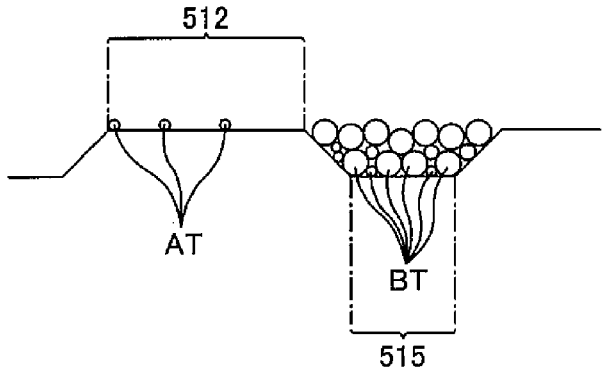
FIG. 15 is a diagram showing a state, at a developing position, of toner borne on the projecting section 512 and the depressed section 515.

As a result, at the developing position in opposition to the photoconductor 20, the toner borne on the projecting section 512 and the depressed section 515 is in such a state that, as shown in FIG. 15, the projecting-section covering rate at which the toner in contact with the projecting section 512 (indicated by the symbol AT in FIG. 15) covers the projecting section 512 is smaller than the depressed-section covering rate at which the toner in contact with the depressed section 515 (indicated by the symbol BT in FIG. 15) covers the depressed section 515. The developing roller 510 develops the latent image in a state where the projecting-section covering rate is smaller than the depressed-section covering rate.

Note that FIG. 15 is a diagram showing a state, at the developing position, of the toner borne on the projecting section 512 and the depressed section 515. FIG. 15 shows the toner being borne not only on the depressed section 515 but also on the projecting section 512. The reason to this is as follows. That is, after passing the regulation blade 560, the toner borne on the depressed section 515 reaches the developing position with the rotation of the developing roller 510. In the course of passing the regulation blade 560 and reaching the developing position, there are instances where a portion of the toner (albeit an extremely small amount) borne on the depressed section 515 moves onto the projecting section 512.

In cases where the developing roller 510 develops the latent image in a state where the projecting-section covering rate is smaller than the depressed-section covering rate, the occurrence of development memory is curbed according to the reason described below.

That is, during the process of charging and supplying the toner by the toner supplying roller 550 for the n+1$^{st}$ revolution, the toner contained in the toner containing member 530 is supplied anew to the first region which appears at the end of the development process for the n h revolution of the developing roller 510 and on which no toner is borne. Further, the sections hereinabove described the fact that, in cases where the toner has a slow electrical-charge buildup characteristic, the toner supplied anew to the first region of the developing roller 510 is not appropriately borne on the first region at the time frictional charging by the toner supplying roller 550 and the developing roller 510 is carried out.

It should be noted here that there are projecting sections 512 and depressed sections 515 within the first region, and the extent of inappropriateness regarding the toner borne in the first region differs depending on whether the toner is borne on the projecting section 512 or the depressed section 515 of the first region. More specifically, the non-projecting section 513 having the depressed section 51S has a wide-mouthed structure that allows the toner to be easily received therein, and therefore, the toner can easily enter into the non-projecting section 513. Further, in cases where the toner enters into the non-projecting section 513, it is packed within the non-projecting section 513, and the cohesion force generated at this time brings about an effect of causing the toner to be borne on the depressed section 515. Thus, as for the depressed section 515, the above-mentioned inappropriateness regarding the toner borne in the first region is reduced, even if the electrical-charge buildup of the toner is slow. On the contrary, such an effect is not obtained for the projecting section 512. Therefore, the extent of inappropriateness is smaller for the depressed section 515 than the projecting section 512.

Therefore, at the time of the development process for the n+1$^{st}$ revolution, the difference between the darkness of the halftone image formed by developing the latent image in opposition to the depressed sections 515 of the first region and the darkness of the halftone image formed by developing the latent image in opposition to the depressed sections 515 of the second region becomes smaller than the difference between the darkness of the halftone image formed by developing the latent image in opposition to the projecting sections 512 of the first region and the darkness of the halftone image formed by developing the latent image in opposition to the projecting sections 512 of the second region. In other words, of the toner on the projecting sections 512 and the depressed sections 515, it is more preferable, to the extent possible, to develop the latent image using the toner borne on the depressed sections 515 in order to curb the occurrence of development memory.

It can be said from the above that, in cases where the developing roller 510 develops the latent image in a state where the projecting-section covering rate is smaller than the depressed-section covering rate, the difference between the darkness of the halftone image formed by developing the latent image in opposition to the first region and the darkness of the halftone image formed by developing the latent image in opposition to the second region is reduced, compared to a case in which the latent image is developed in a state where the projecting-section covering rate is equal to the depressed-section covering rate, for example. Therefore, the occurrence of development memory can be curbed.

Effectiveness of Developing Device According to Present Embodiment

The developing device according to this embodiment includes: a rotatable developing roller 510 that has regularly-arranged projecting sections 512 and non-projecting sections 513, that bears toner whose volume average particle diameter is smaller than a depth of the non-projecting section 513 relative to the projecting section 512, and that develops a latent image borne on a photoconductor 20 with the toner borne on the developing roller 510; and a regulation blade 560 that is for regulating an amount of the toner borne on the developing roller 510 and that abuts, with a predetermined width, against a circumferential surface of the developing roller 510 in a circumferential direction thereof in such a manner that a longitudinal direction of the regulation blade 560 is along a direction of a rotation axis of the developing roller 510, a tip edge 560*b* of the regulation blade 560 in a lateral direction and a thickness direction thereof being located within an abutment nip 560*a* having the predetermined width, the predetermined width being larger than a maximum width, in the circumferential direction, of the non-projecting section 513. With this structure, functionality impairment of the regulation blade 560 is appropriately curbed.

Figure 16A:
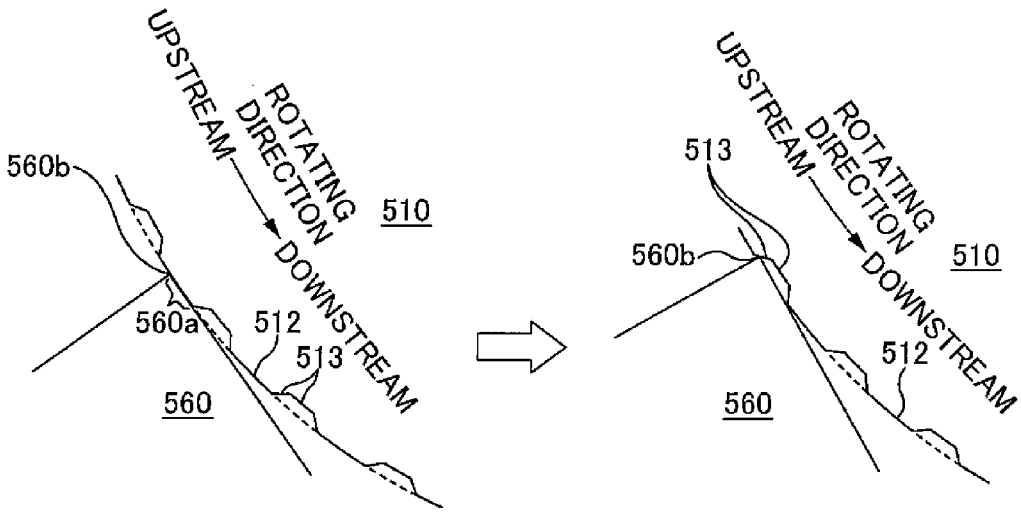
FIGS. 16A and 16B are explanatory diagrams for describing the effectiveness of the developing device according to one embodiment.
Figure 16B:
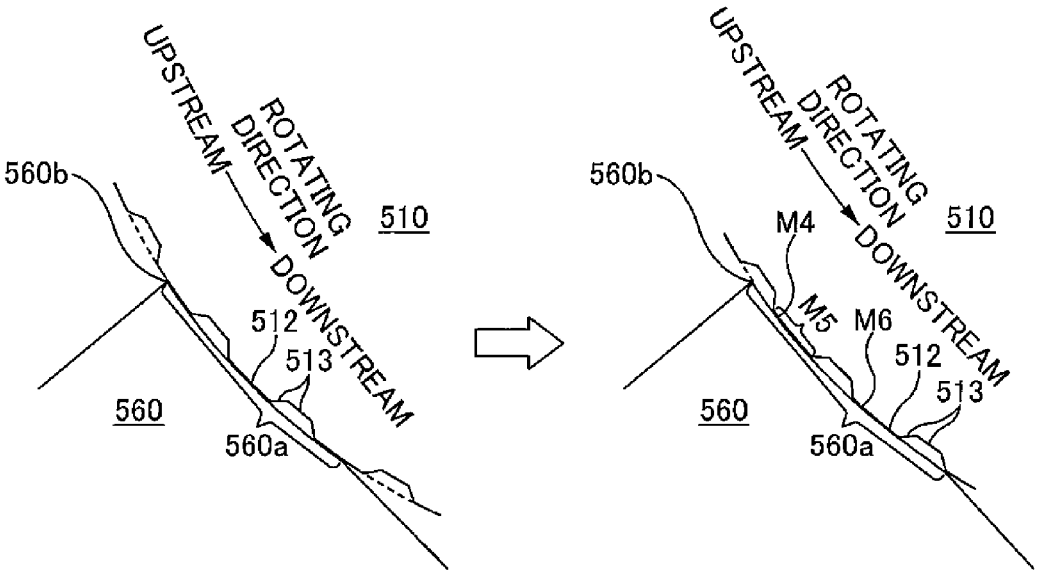

The above fact is described by comparing the developing device according to this embodiment (present example) with a developing device according to a comparative example (heretofore example), with reference to FIGS. 16A and 16B. FIGS. 16A and 16B are explanatory diagrams for describing the effectiveness of the developing device according to this embodiment, and are enlarged schematic diagrams (conceptual diagrams) showing a state around the periphery of the tip edge 560*b* of the regulation blade 560 abutting against the developing roller 510. FIG. 16A is a diagram regarding the comparative example, and FIG. 16B is a diagram regarding the present example. The left diagram of FIG. 16B is the same diagram as FIG. 9, and the right diagram of FIG. 16B is a diagram in which the developing device according to the present example has transitioned from a state shown in the left diagram of FIG. 16B (or FIG. 9) (a state in which the tip edge 560*b* is located at a position in opposition to the projecting section 512) to a state in which the tip edge 560*b* is located at a position in opposition to the non-projecting section 513 as a result of rotation of the developing roller 510. On the other hand, the left and right diagrams of FIG. 16A are diagrams that respectively correspond to the left and right diagrams of FIG. 16B. More specifically, the right diagram of FIG. 16A is a diagram in which the developing device according to the comparative example has transitioned from a state shown in the left diagram of FIG. 16A (a state in which the tip edge 560*b* is located at a position in opposition to the projecting section 512) to a state in which the tip edge 560*b* is located at a position in opposition to the non-projecting section 513 as a result of rotation of the developing roller 510. Note that the developing device according to the comparative example is similar to the present example in terms that it includes: a rotatable developing roller 510 that has regularly-arranged projecting sections 512 and non-projecting sections 513 and that bears toner whose volume average particle diameter is smaller than a depth of the non-projecting section 513 relative to the projecting section 512; and a regulation blade 560 that abuts, with a predetermined width, against a circumferential surface of the developing roller 510 in a circumferential direction thereof and whose tip edge 560*b* is located within an abutment nip 560*a* having the predetermined width. The comparative example, however, is different from the present example in terms that the predetermined width (regulation nip width) is smaller than the maximum width, in the circumferential direction, of the non-projecting section 513.

As described above, edge regulation is effective in situations where development memory is prone to occur. However, as shown in the right diagram of FIG. 16A (the comparative example), in cases where edge regulation is adopted, there is a possibility that, when the tip edge 560*b* is located at a position in opposition to the non-projecting section 513 at the time the regulation blade 560 regulates the amount of toner borne on the developing roller 510, the tip edge 560*b* may enter into the non-projecting section 513. This may cause the tip edge 560*b* to collide against the non-projecting section 513 (in particular, near the boundary of the side section 514 with respect to the projecting section 512), and thereby curl up or chip away. Such a problem is a cause of impairing the functionality of the regulation blade 560. (If this functionality is impaired, image-quality deterioration, such as appearance of image streaks, will occur in the finally-obtained image.)

On the contrary, according to the present example, such a problem is appropriately kept from occurring, because the regulation nip width is larger than the maximum width, in the circumferential direction, of the non-projecting section 513, as shown in FIGS. 9, 10, and 16B. More specifically, in cases where the regulation nip width is larger than the width, in the circumferential direction, of the non-projecting section 513, at least one of the projecting sections 512 is always included within the abutment nip 560*a* having the regulation nip width, regardless of the relative positional relationship between the developing roller 510 (the projecting sections 512 and the non-projecting sections 513 thereof) and the regulation blade 560. In other words, a state in which at least one of the projecting sections 512 is in contact with the regulation blade 560 is always ensured. Furthermore, in cases where the regulation nip width is larger than the maximum width, in the circumferential direction, of the non-projecting section 513—more specifically, in cases where the regulation nip width is larger than the width, in the circumferential direction, of the non-projecting section 513 over a range extending from one end to the other end, in the longitudinal direction, of the regulation blade 560—a state in which at least some of the projecting sections 512 are in contact with the regulation blade 560 is always ensured over the range extending from one end to the other end, in the longitudinal direction, of the regulation blade 560. Thus, even in cases where the above-mentioned relative positional relationship enters a positional relationship in which the tip edge 560*b* is in opposition to the non-projecting sections 513 (refer to the right diagram of FIG. 16B) at the time the regulation blade 560 regulates the amount of toner borne on the developing roller 510, the tip edge 560*b* is appropriately kept from entering into the non-projecting section 513, because at least one projecting section 512 in contact with the regulation blade 560 (for example, the section indicated by the symbol M4 in the right diagram of FIG. 16B) receives (supports) the regulation blade 560. In this way, the tip edge 560*b* is prevented from colliding against the non-projecting section 513 and curling up or chipping away, and thus, functionality impairment of the regulation blade 560 is appropriately curbed.

Further, in order to keep the tip edge 560*b* from entering into the non-projecting section 513 and curb functionality impairment of the regulation blade 560, it is desirable that the entire projecting section 512 (i.e., the area extending from one end to the other end, in the circumferential direction, of the projecting section 512) is always included within the abutment nip 560*a* having the regulation nip width (and not just a portion of the projecting section 512), regardless of the above-mentioned relative positional relationship. The present example is configured in this way, as shown in FIGS. 9, 10, and 16B. More specifically, the condition to be met in order for the entire projecting section 512 to always be included within the abutment nip 560*a* regardless of the above-mentioned relative positional relationship is as follows: the regulation nip width is larger than the above-mentioned first sum, that is, the sum of the width, in the circumferential direction, of the non-projecting section 513 and a value twice the width, in the circumferential direction, of the projecting section 512. (On the contrary, if this condition is not met, there may be instances in which the entire projecting section 512 is not included within the abutment nip 560*a* depending on the above-mentioned relative positional relationship.) As described above, in the present example, this condition is met over the range extending from one end to the other end, in the longitudinal direction, of the regulation blade 560, and therefore, a state in which the entire projecting section 512 is in contact with the regulation blade 560 is always ensured over the range extending from one end to the other end, in the longitudinal direction, of the regulation blade 560. Thus, even in cases where the above-mentioned relative positional relationship enters a positional relationship in which the tip edge 560*b* is in opposition to the non-projecting sections 513 (refer to the right diagram of FIG. 16B) at the time the regulation blade 560 regulates the amount of toner borne on the developing roller 510, the tip edge 560*b* is more appropriately kept from entering into the non-projecting section 513 compared to a case where, for example, only a portion of the projecting section 512 receives the regulation blade 560, because the entire projecting section 512 in contact with the regulation blade 560 (for example, the section indicated by the symbol M5 in the right diagram of FIG. 16B) receives (supports) the regulation blade 560. Thus, functionality impairment of the regulation blade 560 is curbed even more appropriately.

Further, in order to keep the tip edge 560*b* from entering into the non-projecting section 513 and curb functionality impairment of the regulation blade 560, it is desirable that a plurality of projecting sections 512 (in the circumferential direction) are always included within the abutment nip 560*a* having the regulation nip width, regardless of the above-mentioned relative positional relationship. The present example is configured in this way, as shown in FIGS. 9, 10, and 16B. More specifically, the condition to be met in order for a plurality of projecting sections 512 to always be included within the abutment nip 560*a* regardless of the above-mentioned relative positional relationship is as follows: the regulation nip width is larger than the above-mentioned second sum, that is, the sum of a value twice the width, in the circumferential direction, of the non-projecting section 513 and the width, in the circumferential direction, of the projecting section 512. (On the contrary, if this condition is not met, there may be instances in which a plurality of projecting sections 512 are not included within the abutment nip 560*a* depending on the above-mentioned relative positional relationship.) As described above, in the present example, this condition is met over the range extending from one end to the other end, in the longitudinal direction, of the regulation blade 560, and therefore, a state in which a plurality of projecting sections 512 are in contact with the regulation blade 560 is always ensured over the range extending from one end to the other end, in the longitudinal direction, of the regulation blade 560. Thus, even in cases where the above-mentioned relative positional relationship enters a positional relationship in which the tip edge 560*b* is in opposition to the non-projecting sections 513 (refer to the right diagram of FIG. 16B) at the time the regulation blade 560 regulates the amount of toner borne on the developing roller 510, the tip edge 560*b* is more appropriately kept from entering into the non-projecting section 513 compared to a case where, for example, only a single projecting section 512 receives the regulation blade 560, because a plurality of projecting sections 512 in contact with the regulation blade 560 (for example, the section indicated by the symbol M4 and the section indicated by the symbol M6 in the right diagram of FIG. 16B) receive (support) the regulation blade 560. Thus, functionality impairment of the regulation blade 560 is curbed even more appropriately.

Method of Manufacturing Developing Device

Next, a method of manufacturing a developing device is described with reference to FIGS. 17A to 19. FIGS. 17A to 17E are schematic diagrams showing the transformation of the developing roller 510 during a process of manufacturing the developing roller 510. FIG. 18 is an explanatory diagram for describing a rolling process for the developing roller 510. FIG. 19 is a flowchart for describing a method of assembling the yellow developing device 54. Note that in manufacturing the developing device, the above-mentioned housing 540, the holder 526, the developing roller 510, the toner supplying roller 550, the regulation blade 560, etc. are manufactured separately, and then these components are used to assemble the developing device. The present section first describes the method of manufacturing the developing roller 510, among the methods of manufacturing each of the above-mentioned components, and then describes the method of assembling the developing device. Note that the following description takes the yellow developing device 54 as an example, among the black developing device 51, the magenta developing device 52, the cyan developing device 53, and the yellow developing device 54.

Method of Manufacturing Developing Roller 510

Figure 17A:
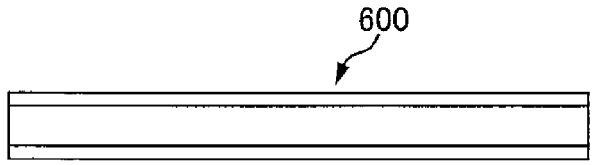
FIGS. 17A to 17E are schematic diagrams showing the transformation of the developing roller 510 during a process of manufacturing the developing roller 510.
Figure 17B:
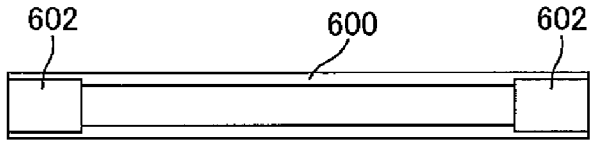
Figure 17C:
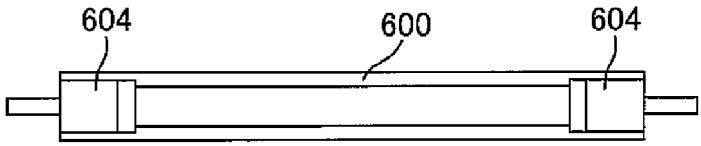
Figure 17D:
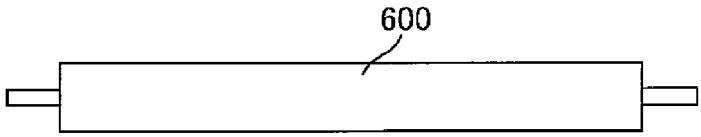
Figure 17E:
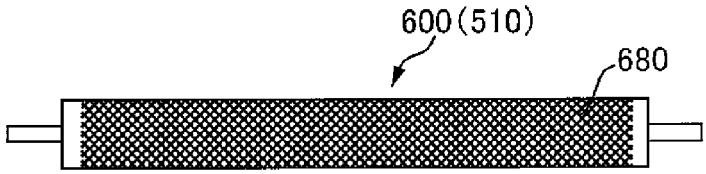
Figure 18:
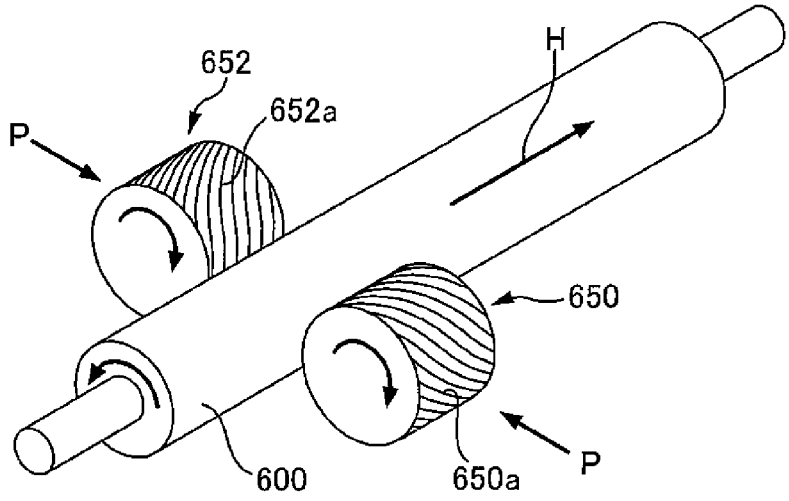
FIG. 18 is an explanatory diagram for describing a rolling process for the developing roller 510.
Figure 19:
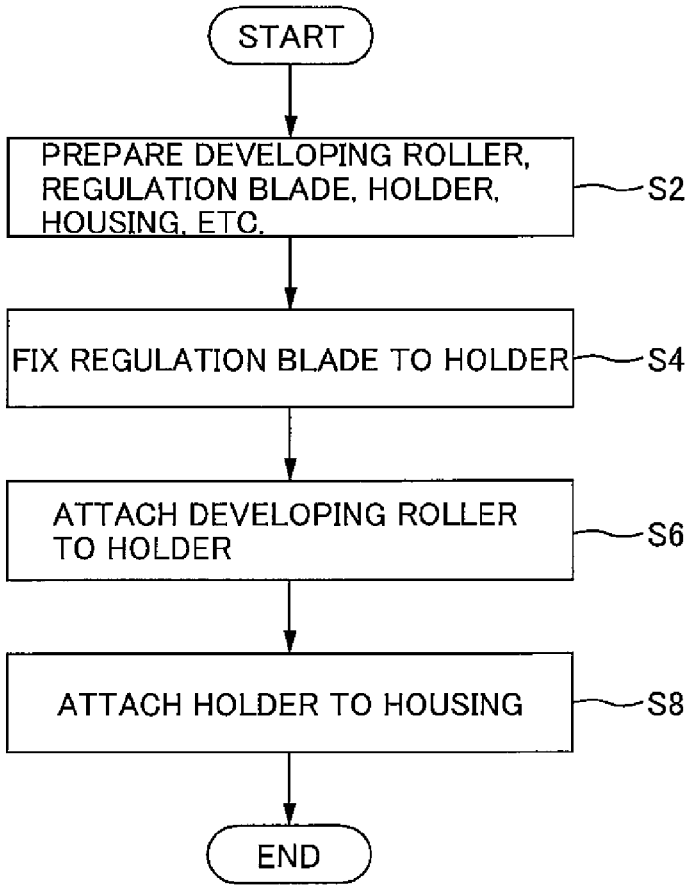
FIG. 19 is a flowchart for describing a method of assembling a yellow developing device 54.

This section describes the method of manufacturing the developing roller 510, with reference to FIGS. 17A to 18.

First, as shown in FIG. 17A, a pipe member 600 is provided as the base material of the developing roller 510. The wall thickness of this pipe member 600 is 0.5 to 3 mm.

Next, as shown in FIG. 17B, flange press-fitting sections 602 are formed on both ends, in the longitudinal direction, of the pipe member 600. The flange press-fitting sections 602 are made by a cutting process.

Next, as shown in FIG. 17C, flanges 604 are respectively press-fitted into the flange press-fitting sections 602. In order to reliably fasten the flanges 604 to the pipe member 600, the flanges 604 may be bonded or welded to the pipe member 600 after press-fitting the flanges 604.

Next, as shown in FIG. 17D, the surface of the pipe member 600 to which the flanges 604 have been press-fitted is subjected to centerless grinding. This centerless grinding is performed on the entire surface, and the ten-point average roughness Rz of the surface after centerless grinding is 1.0 μm or less.

Next, as shown in FIG. 17E, a rolling process is performed on the pipe member 600 to which the flanges 604 have been press-fitted. In this embodiment, the so-called through-feed rolling process (also referred to as continuous rolling) using two round dies 650, 652 is performed.

More specifically, as shown in FIG. 18, the two round dies 650, 652 arranged in such a manner that they sandwich the pipe member 600 serving as a workpiece are rotated in the same direction (see FIG. 18) while being pressed with a predetermined pressure (the direction of this pressure is indicated by the symbol P in FIG. 18) against the pipe member 600. In the through-feed rolling, as the round dies 650, 652 rotate, the pipe member 600 moves in the direction indicated by the symbol H in FIG. 18 while rotating in the opposite direction (see FIG. 18) from the rotating direction of the round dies 650, 652. The surfaces of the round dies 650, 652 have projecting sections 650*a*, 652*a* for forming grooves 680, and these grooves 680 are formed in the pipe member 600 as a result of the projecting sections 650*a*, 652*a* deforming the pipe member 600.

After termination of the rolling process, the surface of the central section 510*a* is plated. In this embodiment, electroless Ni—P plating is employed as the plating. This, however, is not a limitation, and hard chromium plating or electroplating, for example, may be employed.

Method of Assembling Yellow Developing Device 54

Next, the method of assembling the yellow developing device 54 is described with reference to FIG. 19.

First, the above-mentioned housing 540, the holder 526, the developing roller 510, the regulation blade 560, the blade-supporting member 564, etc. are prepared (step S2).

Next, the regulation blade 560 and the blade-supporting member 564 are fixed to the holder 526 by screwing the regulation blade 560 and the blade-supporting member 564 onto the regulation-blade supporting sections 526*c* of the holder 526 (step S4). Note that the above-mentioned end seals 574 are attached to the regulation blade 560 in advance before step S4.

Next, the developing roller 510 is attached to the holder 526 to which the regulation blade 560 and the blade-supporting member 564 have been fixed (step 56). At this time, the developing roller 510 is attached to the holder 526 in such a manner that the regulation blade 560 abuts against the developing roller 510 over a range extending from one end to the other end, in the rotation-axis direction, of the roller 510. Note that the above-mentioned upper seal 520 is attached to the holder 526 in advance before step S6.

Finally, the holder 526, which has the developing roller 510, the regulation blade 560, etc. attached thereto, is attached to the housing 540 via the housing seal 546 (step S8), and accordingly, the assembly of the yellow developing device 54 is completed. Note that the above-mentioned toner supplying roller 550 is attached to the housing 540 in advance before step S8.

Other Embodiments

In the foregoing, a developing device etc. of this invention was described according to the above-mentioned embodiment thereof. However, the foregoing embodiment of the invention is for the purpose of elucidating this invention and is not to be interpreted as limiting the invention. The invention can be altered and improved without departing from the gist thereof, and needless to say, the invention includes its equivalents.

In the foregoing embodiment, an intermediate transferring type full-color laser beam printer was described as an example of the image forming apparatus, but this invention is also applicable to various types of image forming apparatuses, such as full-color laser beam printers that are not of the intermediate transferring type, monochrome laser beam printers, copying machines, and facsimiles.

Further, the photoconductor is not limited to a so-called photoconductive roller having a structure in which a photoconductive layer is provided on the outer circumferential surface of a cylindrical, electrically-conductive base. The photoconductor may be a so-called photoconductive belt structured by providing a photoconductive layer on a surface of a belt-like electrically-conductive base.

Further, the shapes of the projecting sections 512 and the non-projecting sections 513 (the side sections 514 and the depressed sections 515) of the developing roller 510 are not limited to the above.

Further, in the foregoing embodiment, of the first surface 560*c* of the regulation blade 560 along the lateral direction and the second surface 560*d* of the regulation blade 560 along the thickness direction, the abutment nip 560*a* having the predetermined width was provided on the first surface 560*c*; and the tip edge 560*b* was located at one end, in the lateral direction, of the abutment nip 560*a*. This, however, is not a limitation. For example, the abutment nip 560*a* may be provided extending across both the first surface 560*c* and the second surface 560*d*, and the tip edge 560*b* may be located in a central section of the abutment nip 560*a* (i.e., between the first surface 560*c* and the second surface 560*d*).

The foregoing embodiment, however, is more desirable because it is easier to achieve an abutment nip 560*a* having a large regulation nip width and is thus possible to easily achieve a developing device in which the regulation nip width is larger than the maximum width, in the circumferential direction, of the non-projecting section 513.

Figure 20:
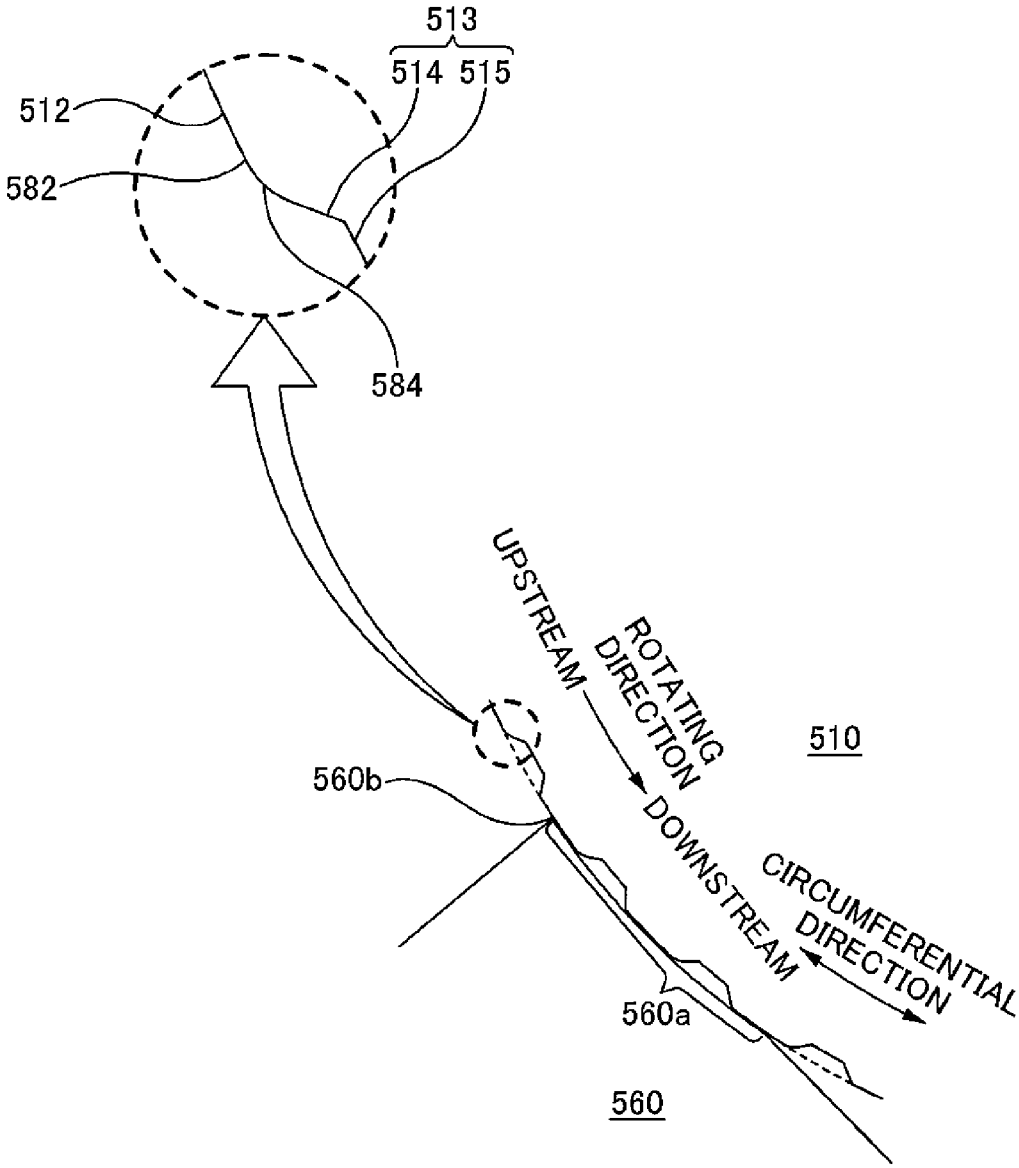
FIG. 20 is an enlarged schematic diagram showing a state around the periphery of the tip edge 560*b* of a developing device according to another embodiment.

Further, as shown in FIG. 20, a boundary 584 between the side section 514 and a section 582 of the projecting section 512 located downstream in the rotating direction of the developing roller 510 may be rounded off. In this way, even if the tip edge 560*b* enters into the non-projecting section 513, the tip edge 560*b* is prevented from colliding against the non-projecting section 513 and curling up or chipping away, and thus, functionality impairment of the regulation blade 560 is appropriately curbed. Note that FIG. 20 is an enlarged schematic diagram (conceptual diagram) showing a state around the periphery of the tip edge 560*b* of a developing device according to another embodiment. Further, this roundness may, for example, be obtained by grinding the developing roller 510 with a grindstone after termination of the rolling process of the developing roller 510 in such a manner that the grindstone comes into contact with the boundary 584 of the developing roller 510.

Furthermore, in the foregoing embodiment, edge regulation was carried out for the purpose of curbing the occurrence of development memory. This invention, however, is not limited to being applied to edge regulation carried out for the above-mentioned purpose, but is also applicable to edge regulation carried out for other purposes. Therefore, although the toner used in the printer 10 according to the foregoing embodiment was described as having characteristics that significantly cause development memory as described in (1) to (4) above, the toner is not limited thereto, and it does not have to possess such characteristics.

Configuration of Image Forming System Etc.

Next, an embodiment of an image forming system, which serves as an example of an embodiment of this invention, is described with reference to the drawings.

Figure 21:
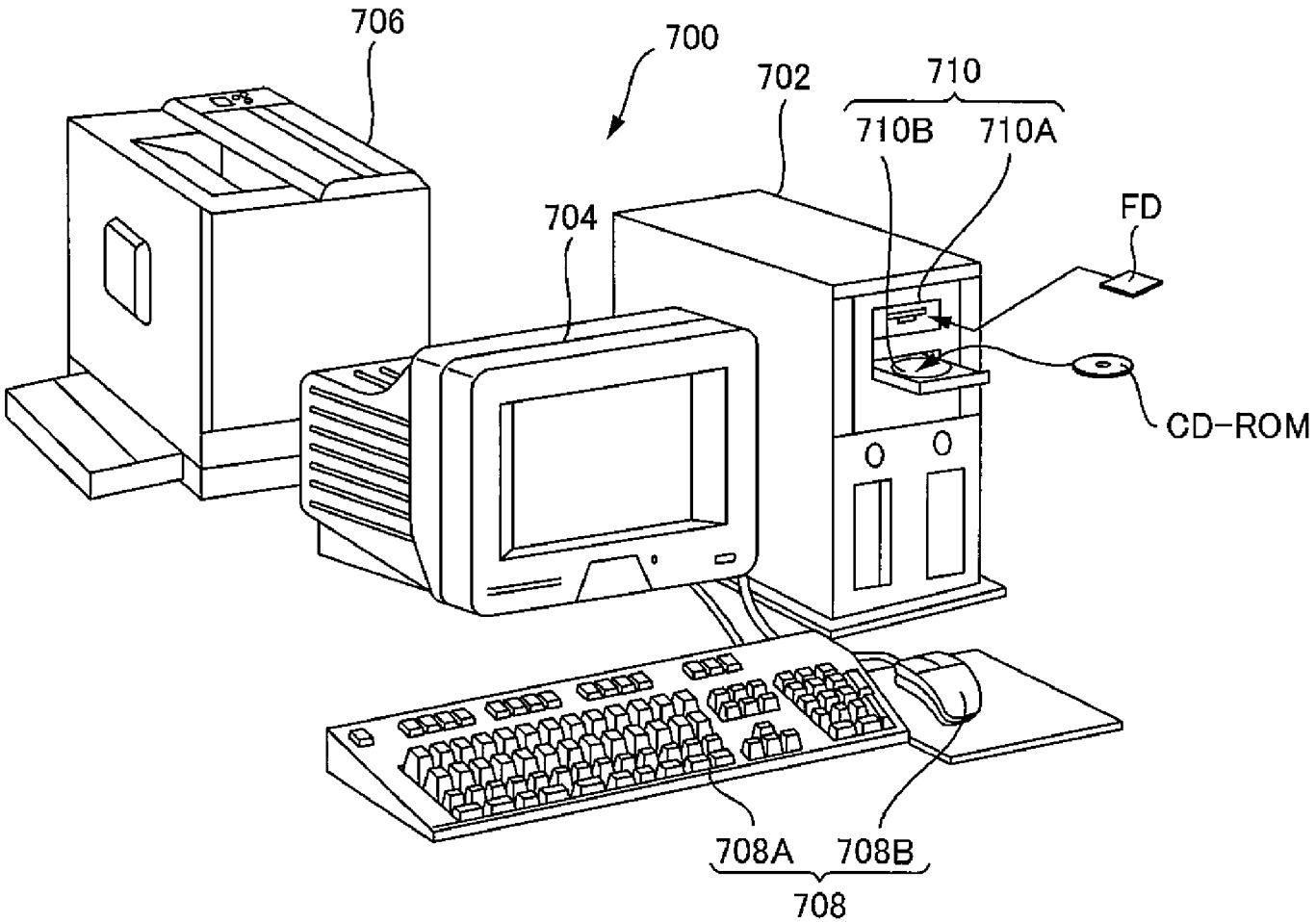
FIG. 21 is an explanatory diagram showing the external structure of an image forming system.

FIG. 21 is an explanatory drawing showing an external structure of an image forming system. The image forming system 700 includes a computer 702, a display device 704, a printer 706, an input device 708, and a reading device 710. In this embodiment, the computer 702 is accommodated in a mini-tower type housing, but this is not a limitation. A CRT (cathode ray tube), a plasma display, or a liquid crystal display device, for example, is generally used as the display device 704, but this is not a limitation. The printer described above is used as the printer 706. In this embodiment, a keyboard 708A and a mouse 708B are used as the input device 708, but this is not a limitation. In this embodiment, a flexible disk drive device 710A and a CD-ROM drive device 710B are used as the reading device 710, but the reading device is not limited thereto, and other devices such as an MO (magneto optical) disk drive device or a DVD (digital versatile disk) may be used.

Figure 22:
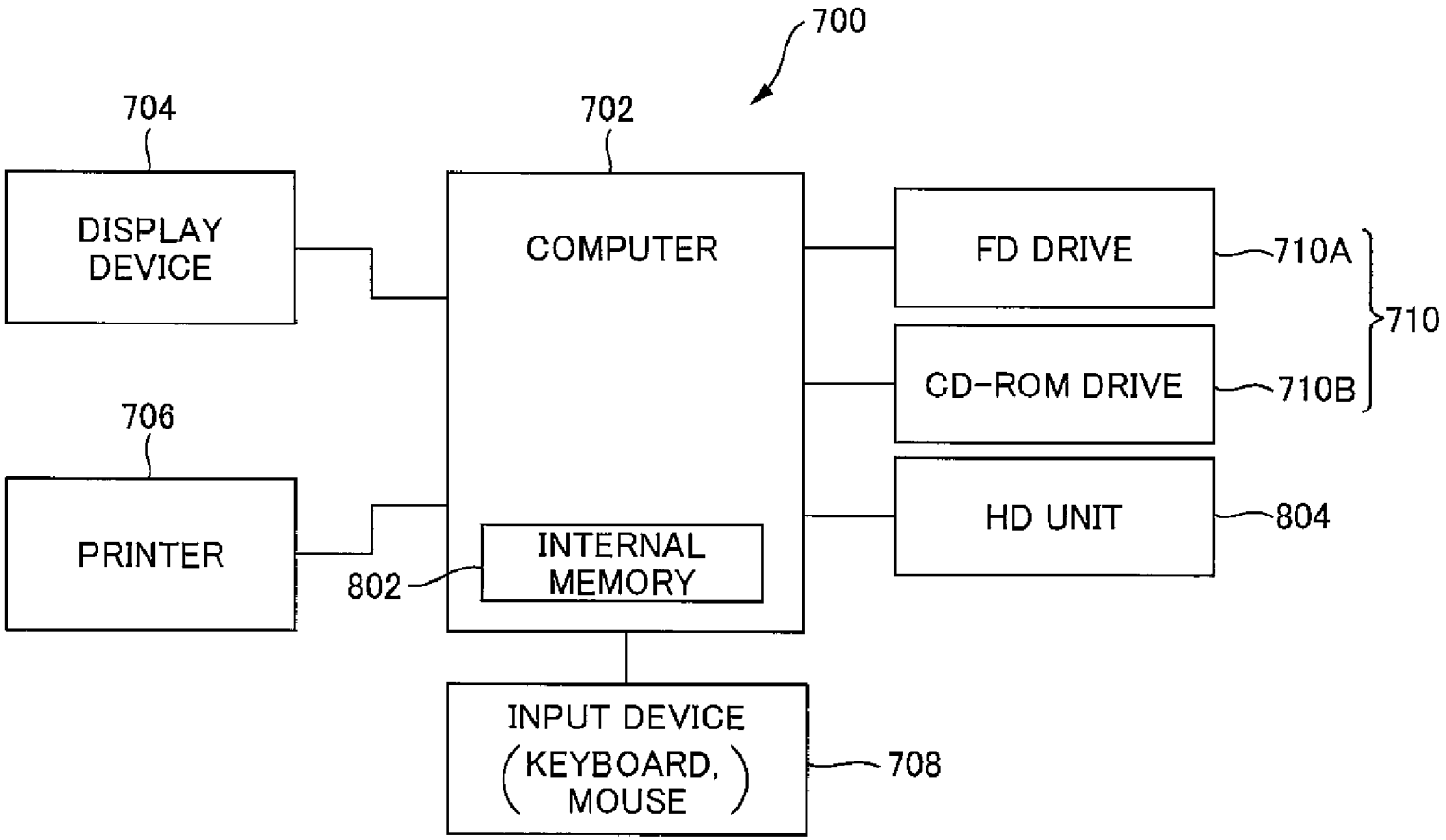
FIG. 22 is a block diagram showing the configuration of the image forming system shown in FIG. 21.

FIG. 22 is a block diagram showing a configuration of the image forming system shown in FIG. 21. Further provided are an internal memory 802, such as a RAM inside the housing accommodating the computer 702, and an external memory such as a hard disk drive unit 804.

Note that in the above description, an example in which the image forming system is structured by connecting the printer 706 to the computer 702, the display device 704, the input device 708, and the reading device 710 was described, but this is not a limitation. For example, the image forming system may be made of the computer 702 and the printer 706, and the image forming system does not have to be provided with one of the display device 704, the input device 708, and the reading device 710.

Further, for example, the printer 706 may have some of the functions or mechanisms of the computer 702, the display device 704, the input device 708, and the reading device 710. As an example, the printer 706 may be configured so as to have an image processing section for carrying out image processing, a displaying section for carrying out various types of displays, and a recording media attach/detach section to and from which recording media storing image data captured by a digital camera or the like are inserted and taken out.

As an overall system, the image forming system that is achieved in this way is superior to heretofore systems.

What is claimed is:

1. A developing device comprising:

a rotatable toner bearing roller that has regularly-arranged projecting sections and non-projecting sections, that bears toner whose volume average particle diameter is smaller than a depth of the non-projecting section relative to the projecting section, and that develops a latent image borne on an image bearing member with the toner borne on the toner bearing roller; and a regulation blade that is for regulating an amount of the toner borne on the toner bearing roller and that abuts, with a predetermined width, against a circumferential surface of the toner bearing roller in a circumferential direction thereof in such a manner that a longitudinal direction of the regulation blade is along a direction of a rotation axis of the toner bearing roller, a tip edge of the regulation blade in a lateral direction and a thickness direction thereof being located within an abutting section having the predetermined width, the predetermined width being larger than a maximum width, in the circumferential direction, of the non-projecting section.

2. A developing device according to claim 1, wherein the predetermined width is larger than a sum of a width, in the circumferential direction, of the non-projecting section and a value twice a width, in the circumferential direction, of the projecting section over a range extending from one end to another end, in the longitudinal direction, of the regulation blade.

3. A developing device according to claim 1, wherein the predetermined width is larger than a sum of a value twice a width, in the circumferential direction, of the non-projecting section and a width, in the circumferential direction, of the projecting section over a range extending from one end to another end, in the longitudinal direction, of the regulation blade.

4. A developing device according to claim 1, wherein:

of a first surface of the regulation blade along the lateral direction and a second surface of the regulation blade along the thickness direction, the abutting section having the predetermined width is provided on the first surface; and the tip edge is located at one end, in the lateral direction, of the abutting section.

5. A developing device according to claim 1, wherein:

the non-projecting section includes a depressed section and a side section that connects the projecting section and the depressed section; and a boundary between the side section and a section of the projecting section located downstream in a rotating direction of the toner bearing roller is rounded off.

6. An image forming apparatus comprising:

an image bearing member for bearing a latent image; and a developing device having a rotatable toner bearing roller that has regularly-arranged projecting sections and non-projecting sections, that bears toner whose volume average particle diameter is smaller than a depth of the non-projecting section relative to the projecting section, and that develops the latent image borne on the image bearing member with the toner borne on the toner bearing roller, and a regulation blade that is for regulating an amount of the toner borne on the toner bearing roller and that abuts, with a predetermined width, against a circumferential surface of the toner bearing roller in a circumferential direction thereof in such a manner that a longitudinal direction of the regulation blade is along a direction of a rotation axis of the toner bearing roller, a tip edge of the regulation blade in a lateral direction and a thickness direction thereof being located within an abutting section having the predetermined width, the predetermined width being larger than a maximum width, in the circumferential direction, of the non-projecting section.

7. An image forming system comprising:

a computer; and an image forming apparatus connectable to the computer, the image forming apparatus having:

an image bearing member for bearing a latent image; and a developing device having a rotatable toner bearing roller that has regularly-arranged projecting sections and non-projecting sections, that bears toner whose volume average particle diameter is smaller than a depth of the non-projecting section relative to the projecting section, and that develops the latent image borne on the image bearing member with the toner borne on the toner bearing roller, and a regulation blade that is for regulating an amount of the toner borne on the toner bearing roller and that abuts, with a predetermined width, against a circumferential surface of the toner bearing roller in a circumferential direction thereof in such a manner that a longitudinal direction of the regulation blade is along a direction of a rotation axis of the toner bearing roller, a tip edge of the regulation blade in a lateral direction and a thickness direction thereof being located within an abutting section having the predetermined width, the predetermined width being larger than a maximum width, in the circumferential direction, of the non-projecting section.

* * * * *